US010962897B2

(12) United States Patent
Takezawa

(10) Patent No.: US 10,962,897 B2
(45) Date of Patent: Mar. 30, 2021

(54) IMAGE FORMING APPARATUS PROVIDED WITH CLEANING MECHANISM

(71) Applicant: CANON KABUSHIKI KAISHA, Tokyo (JP)

(72) Inventor: Satoru Takezawa, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/531,651

(22) Filed: Aug. 5, 2019

(65) Prior Publication Data

US 2020/0050139 A1 Feb. 13, 2020

(30) Foreign Application Priority Data

Aug. 7, 2018 (JP) ..... JP2018-148617

(51) Int. Cl.
*G03G 15/04* (2006.01)
*G03G 15/00* (2006.01)
*G03G 21/20* (2006.01)

(52) U.S. Cl.
CPC . *G03G 15/04072* (2013.01); *G03G 15/04036* (2013.01); *G03G 15/5041* (2013.01); *G03G 21/20* (2013.01); *G03G 2215/00037* (2013.01)

(58) Field of Classification Search
CPC ..... G03G 15/5016; G03G 15/5041; G03G 15/04036; G03G 15/5058; G03G 21/00; G03G 21/20; G03G 21/1666; G03G 2215/00029; G03G 2215/00037; G03G 2215/00042; G03G 2215/00059; G03G 2215/0404; G03G 2221/0005
USPC ..... 399/44, 49, 81, 99, 118
See application file for complete search history.

(56) References Cited

U.S. PATENT DOCUMENTS

2009/0269102 A1* 10/2009 Kaneko ..... G03G 15/04072 399/123
2012/0294631 A1* 11/2012 Burry ..... G03G 15/5062 399/15
2014/0112676 A1* 4/2014 Mori ..... G03G 15/04045 399/49
2014/0348529 A1* 11/2014 Takahashi ..... G03G 15/04036 399/71
2017/0227894 A1* 8/2017 Oba ..... G03G 15/161
2017/0277113 A1* 9/2017 Mimura ..... G03G 21/0058
2017/0371292 A1* 12/2017 Narita ..... G03G 15/0409
(Continued)

FOREIGN PATENT DOCUMENTS

JP 01187576 A * 7/1989
JP 2001109222 A * 4/2001
(Continued)

*Primary Examiner* — Robert B Beatty
(74) *Attorney, Agent, or Firm* — Canon U.S.A., Inc. I.P. Division

(57) ABSTRACT

An image forming apparatus with an image forming unit, including a photosensitive drum and an optical scanning device having a transparent window through which laser light that scans the photosensitive drum passes. The image forming apparatus further includes a cleaning mechanism configured to clean the transparent window and a controller unit configured to control the cleaning mechanism to clean the transparent window, wherein the controller unit controls the image forming unit to form an adjustment pattern on the photosensitive drum after the cleaning mechanism performs a cleaning operation for cleaning the transparent window.

22 Claims, 15 Drawing Sheets

(56) References Cited

U.S. PATENT DOCUMENTS

| | | | | |
|---|---|---|---|---|
| 2018/0063351 | A1* | 3/2018 | Tsuchiya | B41J 29/02 |
| 2019/0384220 | A1* | 12/2019 | Nemoto | G03G 21/203 |

FOREIGN PATENT DOCUMENTS

| | | | |
|---|---|---|---|
| JP | 2008-139336 | A | 6/2008 |
| JP | 2009-008789 | A | 1/2009 |
| JP | 2010-139553 | A | 6/2010 |
| JP | 2015-215486 | A | 12/2015 |
| JP | 2016-31467 | A | 3/2016 |
| JP | 2018-049204 | A | 3/2018 |

* cited by examiner

IMAGE FORMING APPARATUS PROVIDED WITH CLEANING MECHANISM

BACKGROUND

Field of the Disclosure

The present disclosure generally relates to an image forming apparatus, such as an electrophotographic copying machine or a laser beam printer, that forms an image on a recording sheet using an electrophotographic method.

Description of the Related Art

Conventionally, in an image forming apparatus employing an electrophotographic method, such an optical scanning device is provided that irradiates the charged surface of a photosensitive member with laser light, to form an electrostatic latent image. In the image forming apparatus including the optical scanning device, the density of an image changes due to image formation conditions, such as the intensity of the amount of laser light that exposes the photosensitive member. Further, even if the image formation conditions are constant, the amount of electric charge of toner changes due to, for example, the temperature or the humidity, and the density of the image also changes. Thus, for example, a density adjustment method for detecting, using a sensor, the density of an adjustment pattern formed on a photosensitive member and setting image formation conditions as targets is known.

The optical scanning device includes optical system components such as a light source and a mirror, a housing that covers the optical system components, and an opening portion that emits light from the light source to outside the housing. Then, to prevent a foreign substance such as toner or dust from entering the housing, the opening portion is closed by a transmission member that transmits light. If a foreign substance such as toner or dust exists on the transmission member, the light emitted from the opening portion may be blocked by the foreign substance, whereby the optical characteristics may change, and the quality of an image to be formed may be reduced.

Thus, for example, in the publication of Japanese Patent Application Laid-Open No. 2016-31467, a cleaning member rubs against a transparent window to remove a foreign substance attached to the transparent window. This cleaning process is performed every time printing is performed (i.e., images are formed) on a predetermined number of (e.g., 10000) sheets, to maintain the state where the transparent window is less stained.

In the configuration of the publication of Japanese Patent Application Laid-Open No. 2016-31467, however, there is a possibility that an adjustment sequence for adjusting image formation conditions is executed even in the state where a foreign substance, such as toner, is attached to the transparent window. If laser light is emitted from an optical scanning device to a photosensitive member in the state where a part of the transparent window is stained, a defect may occur in the density or the shape of an adjustment pattern formed on a photosensitive member, and the image formation conditions may not be set with high accuracy.

SUMMARY

According to an aspect of the present disclosure, an image forming apparatus includes an image forming unit, including a photosensitive drum and an optical scanning device having a transparent window through which laser light that scans the photosensitive drum passes, configured to develop an electrostatic latent image using toner, the electrostatic latent image being formed on the photosensitive drum by being scanned by the laser light, wherein the image forming unit forms an adjustment pattern on the photosensitive drum in response to an execution signal being generated, the execution signal being for giving an instruction to execute an adjustment sequence for adjusting an image formation condition for forming a toner image on a recording sheet, a cleaning mechanism configured to clean the transparent window, and a controller unit configured to control the cleaning mechanism to clean the transparent window, and wherein in the adjustment sequence executed in response to the execution signal, the controller unit controls the image forming unit to form the adjustment pattern on the photosensitive drum after the cleaning mechanism performs a cleaning operation for cleaning the transparent window.

Further features of the present disclosure will become apparent from the following description of exemplary embodiments with reference to the attached drawings.

DESCRIPTION OF THE EMBODIMENTS

With reference to the drawings, embodiments for carrying out the present disclosure will be described below. The dimensions, the materials, the shapes, and the relative arrangement of the components described below do not limit the scope of the disclosure to them only, unless specifically stated otherwise.

(Image Forming Apparatus)

Figure 1:
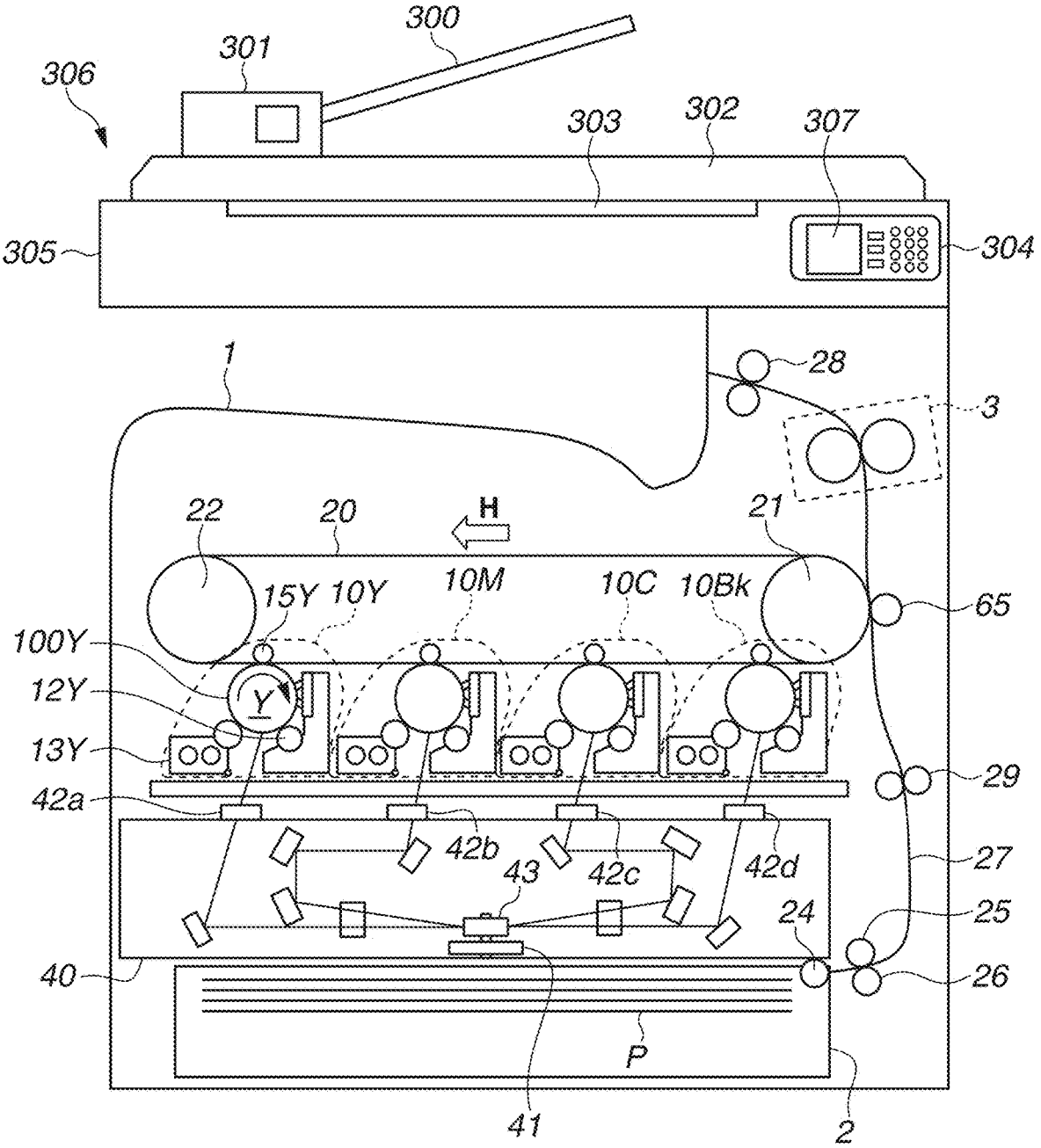
FIG. 1 is a schematic cross-sectional view of an image forming apparatus.

FIG. 1 is a schematic cross-sectional view illustrating the overall configuration of an image forming apparatus 1 according to a first exemplary embodiment. As illustrated in FIG. 1, the image forming apparatus 1 according to the present exemplary embodiment is a tandem color laser beam printer including four image formation units 10Y, 10M, 10C, and 10Bk that form toner images of yellow (Y), magenta (M), cyan (C), and black (Bk) colors, respectively.

As illustrated in FIG. 1, the image forming apparatus 1 according to the present exemplary embodiment includes a reader unit 306 on the main body of the apparatus. The reader unit 306 includes a document conveying device 301 that automatically conveys a document, a document reading unit 305 (an example of a reading device) that reads an image on the conveyed document, and a document discharge tray 302 onto which the document is discharged.

The document conveying device 301 includes a document sheet feeding tray 300 on which documents are set. The document conveying device 301 conveys the documents placed on the document sheet feeding tray 300 one by one to a document reading position on glass 303 of the document reading unit 305. Each document conveyed onto the glass 303 is read by the document reading unit 305. Then, the document conveying device 301 further conveys the document and discharges the document onto the document discharge tray 302.

The document reading unit 305 includes a scanner and a full-color charge-coupled device (CCD) sensor (not illustrated). The scanner performs exposure scanning on a document conveyed onto the glass 303 by the document conveying device 301. The CCD sensor converts light reflected from the document exposed by the scanner into electric signals. If the document is subjected to exposure scanning by the scanner, the CCD sensor performs photoelectric conversion. Consequently, electric signals having red (r), green (g), and blue (b) components indicating an image are sent to an image processing control unit 411.

The image forming apparatus 1 includes the image formation units 10Y, 10M, 10C, and 10Bk that transfer an image read by the document reading unit 305 onto a sheet as a recording sheet, to reproduce the read image on the sheet. In the present disclosure, examples of the recording sheet not only include paper for use in general printing, but also broadly include cloth, plastic, and film.

Further, as illustrated in FIG. 1, the image forming apparatus 1 according to the present exemplary embodiment includes an operation unit 304. The operation unit 304 includes a display 307 (an example of a display unit) that displays setting information regarding printing conditions to an operator, such as a user or a serviceman.

The display 307 can display software keys that are operated by the operator contacting the software keys with their finger. Using the display 307, the operator can input information indicating one-sided printing or two-sided printing through an operation panel. The operation unit 304 includes a start key that is pressed to start an image forming operation, and a stop key that is pressed to suspend an image forming operation. A numeric keypad is keys that are pressed to make numeric settings. In the image forming apparatus 1 according to the present exemplary embodiment, the start key, the stop key, and the numeric keypad are provided as hardware keys in the operation unit 304, but may be displayed as software keys on the display 307. Various types of data input through the operation unit 304 are stored in a random-access memory (RAM) 415 via a central processing unit (CPU) 417 (an example of a controller unit).

The image forming apparatus 1 includes an intermediate transfer belt 20 onto which toner images formed by the image formation units 10Y, 10M, 10C, and 10Bk are transferred. The intermediate transfer belt 20 transfers onto a sheet P the toner images transferred from the respective image formation units 10. The image formation units 10Y, 10M, 10C, and 10Bk are configured approximately similarly to each other, except that the colors of toners used in the image formation units 10Y, 10M, 10C, and 10Bk are different from each other. Each image formation unit 10 is described below using the image formation unit 10Y as an example. The image formation units 10M, 10C, and 10Bk are not redundantly described.

The image formation unit 10 includes a photosensitive drum 100, a charging roller 12 that uniformly charges the photosensitive drum 100, a developing device 13 that develops, using toner, an electrostatic latent image formed on the photosensitive drum 100 by an optical scanning device 40, to form a toner image, and a primary transfer roller 15 that transfers the formed toner image onto the intermediate transfer belt 20. The primary transfer roller 15 forms a primary transfer unit with the photosensitive drum 100 through the intermediate transfer belt 20. A predetermined transfer voltage is applied to the primary transfer roller 15, whereby the primary transfer roller 15 transfers the toner image formed on the photosensitive drum 100 onto the intermediate transfer belt 20. The optical scanning device 40 and the developing device 13 are components forming an image forming unit.

The intermediate transfer belt 20 is an endless belt hung around a first belt conveying roller 21 and a second belt conveying roller 22 and rotationally moves in the direction of an arrow H. Onto the intermediate transfer belt 20 that is rotating, the toner images formed by the image formation units 10 are transferred. In this case, the four image formation units 10Y, 10M, 10C, and 10Bk are disposed in parallel vertically below the intermediate transfer belt 20. Consequently, onto the intermediate transfer belt 20, toner images formed on the photosensitive drums 100 according to pieces of image information regarding the respective colors are transferred.

Further, the first belt conveying roller 21 and a secondary transfer roller 65 are in pressure contact with each other across the intermediate transfer belt 20. With such an arrangement, the first belt conveying roller 21 forms a secondary transfer unit with the secondary transfer roller 65 through the intermediate transfer belt 20. A sheet P is inserted into the secondary transfer unit, and the toner images are transferred from the intermediate transfer belt 20 onto the sheet P. Transfer residual toner remaining on the surface of the intermediate transfer belt 20 is collected by a cleaning device (not illustrated).

The image formation units 10 of the respective colors are placed such that in the rotational direction of the intermediate transfer belt 20 (the direction of the arrow H), the image formation unit 10Y that forms a yellow toner image, the image formation unit 10M that forms a magenta toner image, the image formation unit 10C that forms a cyan toner image, and the image formation unit 10Bk that forms a black toner image are arranged in order from the upstream side relative to the secondary transfer unit.

Further, vertically below the image formation units 10, the optical scanning device 40 is provided that scans beams of laser light on the photosensitive drums 100, to form electrostatic latent images on the photosensitive drums 100.

The optical scanning device 40 includes a rotary polygon mirror 43 and four semiconductor lasers (not illustrated) that emit beams of laser light modulated according to pieces of image information regarding the respective colors. The semiconductor lasers are light sources for exposing the corresponding photosensitive drums 100. The rotary polygon mirror 43 is rotated at high speed by a polygon motor 422 (not illustrated). Consequently, the beams of laser light emitted from the semiconductor lasers are deflected to scan along the rotational axis directions of the photosensitive drums 100. The beams of laser light deflected by the rotary polygon mirror 43 are guided by optical members disposed inside the optical scanning device 40 and emitted from inside to outside the optical scanning device 40 through transmission members (examples of a transparent window) 42*a* to 42*d* that cover opening portions provided in an upper portion of the optical scanning device 40. The beams of laser light emitted from the optical scanning device 40 expose the photosensitive drums 100.

Meanwhile, sheets P are stored in a feed cassette 2 placed in a lower portion of the image forming apparatus 1. Then, the sheets P are fed by a pickup roller 24 to a separation nip portion formed by a feed roller 25 and a retard roller 26. In this case, drive is transmitted to the retard roller 26 so that if a plurality of sheets P is fed by the pickup roller 24, the retard roller 26 rotates backward. The sheets P are conveyed downstream one by one, to prevent multi-feed of the sheets P. Each sheet P conveyed by the feed roller 25 and the retard roller 26 is conveyed to a conveying path 27 that extends approximately vertically along a right side surface of the image forming apparatus 1.

Then, the sheet P is conveyed from the lower side to the upper side in the vertical direction of the image forming apparatus 1 through the conveying path 27 and conveyed to registration rollers 29. The registration rollers 29 temporarily stop the conveyed sheet P and correct the skew of the sheet P. Then, the registration rollers 29 convey the sheet P to the secondary transfer unit according to the timing when toner images formed on the intermediate transfer belt 20 are conveyed to the secondary transfer unit. Then, the sheet P onto which the toner images are transferred by the secondary transfer unit is conveyed to a fixing device 3 and heated and pressurized by the fixing device 3, whereby the toner images are fixed to the sheet P. Then, the sheet P to which the toner images are fixed is discharged by discharge rollers 28 to a discharge tray provided outside the image forming apparatus 1 and in an upper portion of the main body of the image forming apparatus 1.

(Control System of Image Forming Apparatus)

Figure 2:
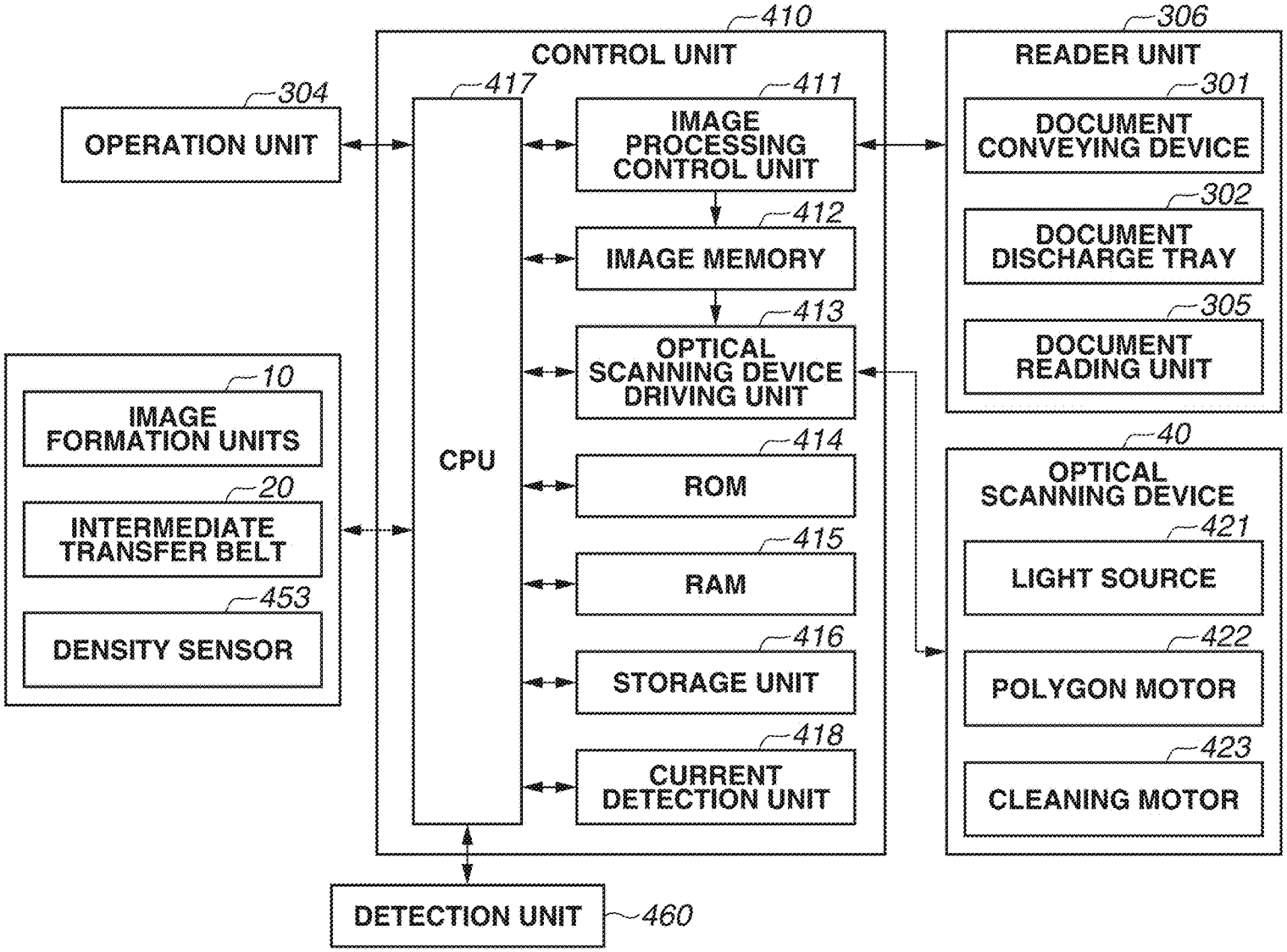
FIG. 2 is a diagram illustrating a control system of the image forming apparatus.

FIG. 2 illustrates the configuration of a control unit 410 of the image forming apparatus 1 according to the present exemplary embodiment. As illustrated in FIG. 2, the control unit 410 controls the optical scanning device 40, the operation unit 304, the reader unit 306, a detecting unit 460, the image formation units 10, the intermediate transfer belt 20, and a density sensor 453. These components operate in conjunction with each other, whereby the image forming apparatus 1 operates.

The control unit 410 includes an image processing control unit 411, an image memory 412, an optical scanning device driving unit 413, a read-only memory (ROM) 414, the RAM 415, a storage unit 416, and a current detecting unit 418. The control unit 410 may be at least one processor. The image processing control unit 411 performs a correction process such as shading correction on image data read by the CCD sensor included in the document reading unit 305. The image data read by the CCD sensor is photoelectrically converted into electric signals having red (r), green (g), and blue (b) components indicating an image. Then, the electric signals are sent to the image processing control unit 411. These electric signals are converted into image data of Y, M, C, and Bk colors by the image processing control unit 411. The image data after the conversion is stored in the image memory 412.

The image memory 412 temporarily stores image data read by the document reading unit 305. Further, if the CPU 417 indicates an address and calls the image memory 412, the image memory 412 sends image data stored at the indicated address to the optical scanning device driving unit 413 in page units. The "page units" mean the units of either one of the front and back sides of a sheet. For example, if two-sided printing is performed on an A4 sheet, this "single sheet" is a "two-page sheet".

Based on image data from the image memory 412, the optical scanning device driving unit 413 controls the optical scanning device 40. Examples of the specific content of the control include the adjustment of the amount of light of a light source 421, the adjustment of the rotational speed of the polygon motor 422, and the control of the driving of a cleaning motor 423.

The ROM 414 stores a program necessary to control the image processing control unit 411, the optical scanning device driving unit 413, and the reader unit 306. Based on a control program in the ROM 414, the CPU 417 controls the operations of components, such as the document conveying device 301, the document reading unit 305, and the image formation units 10. in the controlling, the RAM 415 is a work area used to execute a program by the CPU 417. The "work area" as used herein refers to a storage area temporarily used to execute a program by the CPU 417.

The storage unit 416 according to the present exemplary embodiment is, for example, a non-volatile memory that stores the number of pages on which images are formed. Although the details will be described below, every time an image forming process on a single page of a sheet is executed, the CPU 417 increments a currently stored count value (the value of a counter) n by "1". Consequently, the number of pages on which the image forming process is executed is accumulated.

To drive a wind-up motor 55, the current detecting unit 418 detects a driving current flowing through the wind-up motor 55. Although the details will be described below, the current detecting unit 418 detects the load on the wind-up motor 55 from the value of the driving current.

Further, the image forming apparatus 1 according to the present exemplary embodiment includes the detecting unit 460 that normally detects the temperature outside the image forming apparatus 1. Information to be detected by the detecting unit 460 is not limited to the temperature outside the apparatus, and may be the humidity outside the apparatus. Further, a portion where temperature is detected is not limited to outside the apparatus, either, and may be inside a housing of the optical scanning device 40. In the present exemplary embodiment, the information detected by the detecting unit 460 is stored in the storage unit 416 (an example of a temperature storage unit). The storage location of the information detected by the detecting unit 460 is not limited to the storage unit 416. Alternatively, the information may be stored in a non-volatile memory such as the ROM 414.

(Optical Scanning Device)

Figure 3:
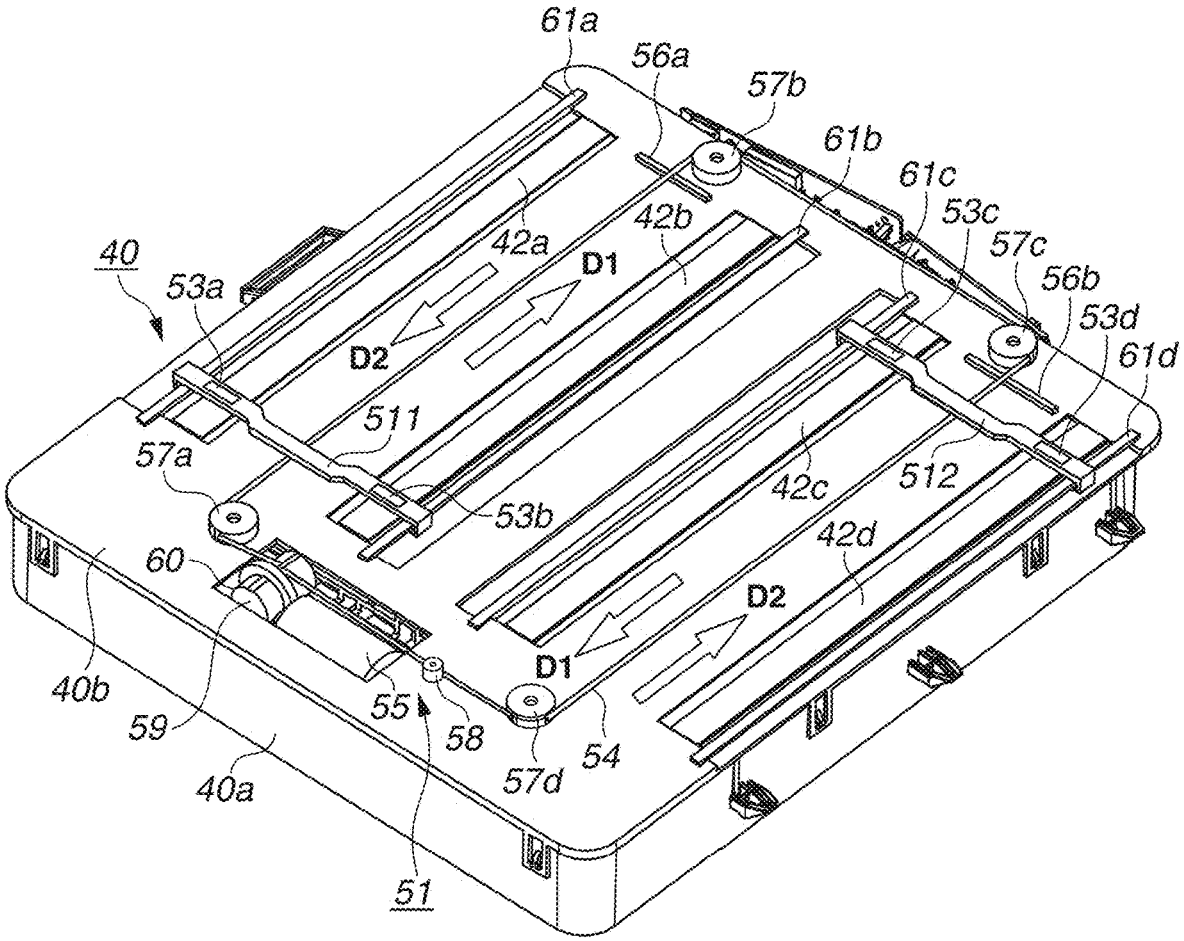
FIG. 3 is a perspective view of an optical scanning device.
Figure 4:
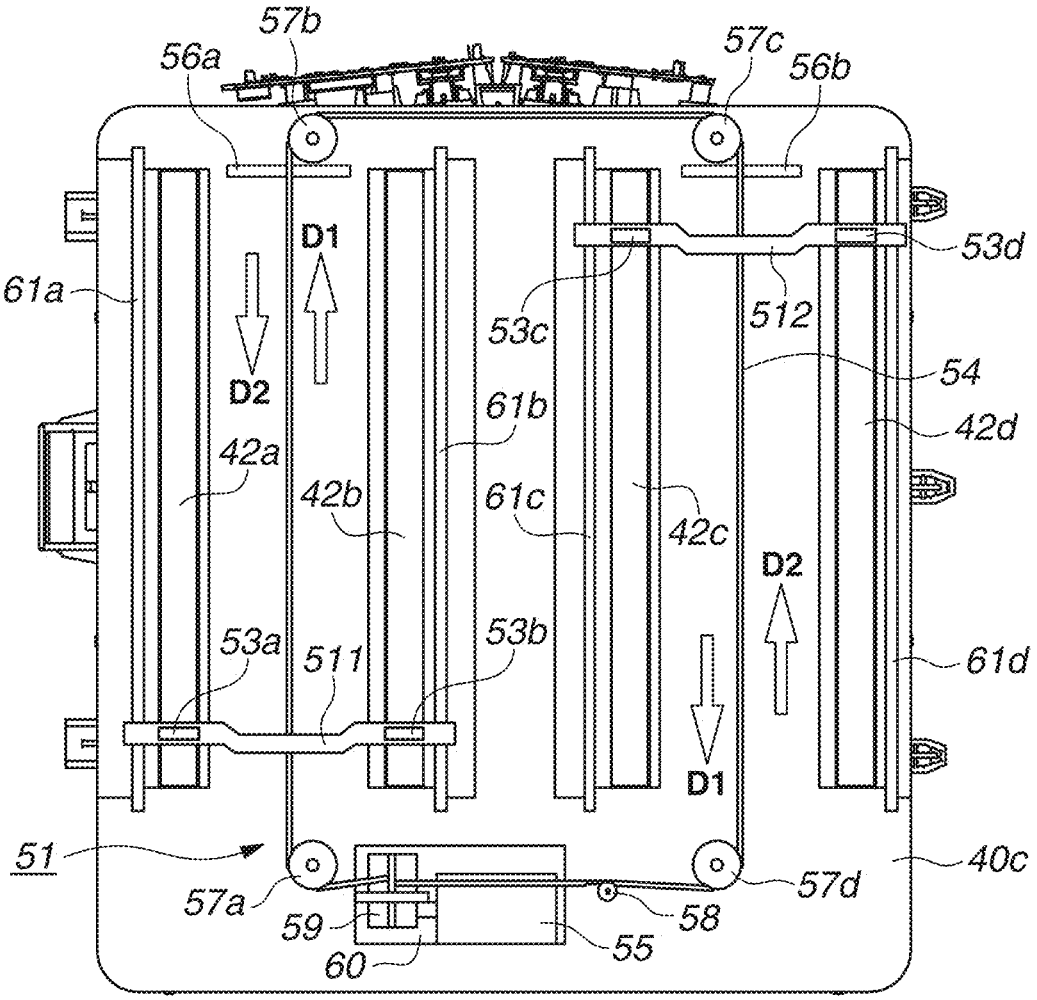
FIG. 4 is a top view of the optical scanning device.

FIG. 3 is a perspective view illustrating the entirety of the optical scanning device 40. FIG. 4 is a top view of the optical scanning device 40. As illustrated in FIGS. 3 and 4, the optical scanning device 40 includes an accommodation portion 40*a* that accommodates the polygon motor 422 and the rotary polygon mirror 43 inside the optical scanning device 40, and a cover portion 40*b* that is attached to the accommodation portion 40*a* and covers an upper surface of the accommodation portion 40*a*. The accommodation portion 40*a* and the cover portion 40*b* form the housing of the optical scanning device 40. In the cover portion 40*b*, four opening portions through which beams of laser light pass are provided corresponding to the photosensitive drums 100 of the respective colors. Each opening portion has a rectangular shape that is long in the rotational axis direction of the corresponding photosensitive drum 100, and the opening portions are formed extending parallel to each other in their longitudinal directions. The opening portions are closed by the transmission members 42*a* to 42*d* that are each formed into a long rectangular shape. Similarly to the opening portions, four transmission members 42*a* to 42*d* are provided and attached to the cover portion 40*b*, extending parallel to each other in their longitudinal directions. The longitudinal directions of the transmission members 42*a* to 42*d* are approximately equal to the scanning directions of beams of laser light emitted from the optical scanning device 40. Further, in the present exemplary embodiment, the longitudinal directions of the transmission members 42*a* to 42*d* are approximately equal to the rotational axis directions of the photosensitive drums 100.

The transmission members 42*a* to 42*d* are provided to prevent a foreign substance such as toner, dust, or paper dust from entering the optical scanning device 40. The transmission members 42*a* to 42*d* prevent a foreign substance to attach to the semiconductor lasers, the mirror, or the rotary polygon mirror 43, so that a reduction in image quality is prevented. The transmission members 42*a* to 42*d* are each formed of a transparent member such as glass, and can emit, to the photosensitive drums 100, beams of laser light emitted from the semiconductor lasers in the accommodation portion 40*a*. In the present exemplary embodiment, the sizes of the transmission members 42*a* to 42*d* are set to be larger than those of the openings of the opening portions in such a manner that the transmission members 42*a* to 42*d* cover the opening portions in an overlapping manner Portions of the transmission members 42*a* to 42*d* that overlap the opening portions are bonded, whereby the transmission members 42*a* to 42*d* are fixed to the cover portion 40*b*.

As described above, the optical scanning device 40 is covered by the cover portion 40*b* and the transmission members 42*a* to 42*d*, whereby a foreign substance such as toner, paper dust, or dust does not enter the optical scanning device 40. Further, the transmission members 42*a* to 42*d* larger than the opening portions are bonded and fixed to the cover portion 40*b*, to prevent a foreign substance such as toner, paper dust, or dust that falls from above the optical scanning device 40 from entering the optical scanning device 40 through the gaps between the transmission members 42*a* to 42*d* and the opening portions.

(Cleaning Mechanism)

The image forming apparatus 1 is configured such that the image formation units 10 are provided above the optical scanning device 40. Thus, there is a case where according to an image forming operation, a foreign substance such as toner, paper dust, or dust falls on the transmission members 42*a* to 42*d* provided in the upper portion of the optical scanning device 40. In this case, beams of laser light to be emitted to the photosensitive drums 100 through the transmission members 42*a* to 42*d* are blocked by the foreign substance. The foreign substance changes the optical characteristics, and consequently, the quality of an image is reduced.

Thus, in the present exemplary embodiment, the optical scanning device 40 includes a cleaning mechanism 51 that performs a cleaning process for cleaning a foreign substance fallen on an upper surface of the optical scanning device 40 (upper surfaces of the transmission members 42*a* to 42*d*) from above the optical scanning device 40. The "upper surfaces of the transmission members 42*a* to 42*d*" are surfaces on the outer side relative to the optical scanning device 40 and surfaces on the side to which beams of laser light passing through the transmission members 42*a* to 42*d* are emitted. With reference to FIGS. 3 and 4, the cleaning mechanism 51 is described below.

The cleaning mechanism 51 is attached on the cover portion 40*b* of the optical scanning device 40 and on the side where the surface of the optical scanning device 40 is opposed to the image formation units 10. The cleaning mechanism 51 includes cleaning members 53*a* to 53*d* that clean the upper surfaces of the transmission members 42*a* to 42*d* (the surface on the outer side of the optical scanning device 40), and a first cleaning holder 511 and a second cleaning holder 512 that move the cleaning members 53*a* to 53*d* on the transmission members 42*a* to 42*d* by holding the cleaning members 53*a* to 53*d*.

Each of the first cleaning holder 511 and the second cleaning holder 512 extends, over two of the transmission members 42 adjacent to each other, in a direction orthogonal to the directions in which the transmission members 42 extend, and includes two of the cleaning members 53. As many cleaning members 53 as the number of the transmission members 42 are provided in the first cleaning holder 511 and the second cleaning holder 512.

That is, the first cleaning holder 511 is disposed extending over the transmission members 42*a* and 42*b* and includes the cleaning member 53*a* that cleans the upper surface of the transmission member 42*a*, and the cleaning member 53*b* that cleans the upper surface of the transmission member 42*b*. Further, the second cleaning holder 512 is disposed extending over the transmission members 42*c* and 42*d* and includes the cleaning member 53*b* that cleans the upper surface of the transmission member 42*c*, and the cleaning member 53*d* that cleans the upper surface of the transmission member 42*d*.

The cleaning members 53*a* to 53*d* each include, for example, silicon rubber or non-woven fabric and move in contact with the upper surface of the corresponding transmission member 42 according to the movements of the first cleaning holder 511 and the second cleaning holder 512, whereby a foreign substance on the transmission members 42 can be removed. Thus, the cleaning members 53 can clean the transmission members 42.

A center portion of the first cleaning holder 511 is joined to a wire 54, and the first cleaning holder 511 has the cleaning members 53*a* and 53*b* on its respective end sides centered on the wire 54. Further, a center portion of the second cleaning holder 512 is joined to the wire 54, and the second cleaning holder 512 has the cleaning members 53*c* and 53*d* on its respective end sides centered on the wire 54. The wire 54 is tightly stretched to pass between the transmission members 42*a* and 42*b* and between the transmission members 42*c* and 42*d*.

Further, the wire 54 is circularly tightly stretched on the cover portion 40*b* by four tight stretching pulleys 57*a* to 57*d* rotatably held by the cover portion 40*b*, a tension adjustment pulley 58, and a wind-up drum 59. Then, the wire 54 is stretched around the tight stretching pulleys 57*a* to 57*d* in the state where the length of the wire 54 is adjusted by the wind-up drum 59 winding up the wire 54 a predetermined number of times when the apparatus is assembled. In this configuration, the four tight stretching pulleys 57*a* to 57*d* are placed in such a manner that as described above, the wire 54 passes between the transmission members 42*a* and 42*b* and between the transmission members 42*c* and 42*d*.

The tension of the wire 54 is adjusted by the tension adjustment pulley 58 provided between the tight stretching pulleys 57*a* and 57*d*. Thus, the wire 54 is disposed in the state where the wire 54 is stretched without loosening between the tight stretching pulleys 57*a* and 57*d*, the tension adjustment pulley 58, and the wind-up drum 59. With this configuration, by tightly stretching the wire 54, it is possible to smoothly circularly run the wire 54.

According to the present exemplary embodiment, the tension adjustment pulley 58 is provided between the tight stretching pulleys 57*a* and 57*d*. The position of the tension adjustment pulley 58, however, may not be limited to this position so long as the tension adjustment pulley 58 can adjust the tension of the wire 57 stretched around the tight stretching pulleys 57*a* to 57*d*.

As described above, according to the present exemplary embodiment, the cleaning members 53*a* and 53*b* are provided in the first cleaning holder 511, and the cleaning members 53*c* and 53*d* are provided in the second cleaning holder 512. In contrast, in a case where a single cleaning member is held by a single cleaning holder, as many cleaning holders as the number of transmission members need to be included. Consequently, the length of a wire tightly stretched and joined to the cleaning holders becomes great. According to the present exemplary embodiment, the number of cleaning holders can be reduced as compared with, and the length of the wire 54 can be smaller than, the number of cleaning holders and the length of the wire in the configuration in which a single cleaning member is held by a single cleaning holder. Thus, it is possible to clean the upper surfaces of the transmission members 42*a* to 42*d* with a simpler configuration.

Further, the wind-up drum 59 is configured to be rotatable by the driving of the wind-up motor 55 as a driving unit.

The wind-up motor 55 is configured to be rotatable forward and backward. In the present exemplary embodiment, the direction of the forward rotation of the wind-up motor 55 is a clockwise (CW) direction, and the direction of the backward rotation of the wind-up motor 55 is a counterclockwise (CCW) direction.

Specifically, the wire 54 is wound up around or pulled out of the wind-up drum 59 by the wind-up drum 59 rotating by the rotation of the wind-up motor 55 in the CW direction or the CCW direction. By being thus wound up around or pulled out of the wind-up drum 59, the wire 54 can circularly run on the cover portion 40*b* in the state where the wire 54 is stretched around the tight stretching pulleys 57*a* and 57*d*.

Thus, according to the running of the wire 54, the first cleaning holder 511 and the second cleaning holder 512 that are joined to the wire 54 can move in the directions of arrows D1 and D2 (the longitudinal directions of the transmission members 42). In the present exemplary embodiment, the wind-up motor 55 rotates in the CCW direction, whereby the first cleaning holder 511 and the second cleaning holder 512 move in the direction of the arrow D1. Further, the wind-up motor 55 rotates in the CW direction, whereby the first cleaning holder 511 and the second cleaning holder 512 move in the direction of the arrow D2.

In the movement, since the wire 54 is circularly tightly stretched, the first cleaning holder 511 and the second cleaning holder 512 move linearly in directions opposite to each other in the longitudinal directions of the transmission members 42*a* to 42*d* by the movement of the wire 54.

In this configuration, the wind-up motor 55 and the wind-up drum 59 are provided in a recessed portion 60 that is provided in a recessed manner on an upper surface of the cover portion 40*b*. With this configuration, the height direction of the optical scanning device 40 can be made small. The recessed portion 60 does not communicate with the inside of the optical scanning device 40, and is provided in such a manner that a foreign substance does not enter the optical scanning device 40 through the recessed portion 60, either.

In the cover portion 40*b*, a first stopper 56*a* is provided that restricts the movement of the first cleaning holder 511 in the longitudinal directions of the transmission members 42*a* and 42*b* (the rotational axis directions of the photosensitive drums 100). Further, in the cover portion 40*b*, a second stopper 56*b* is provided that restricts the movement of the second cleaning holder 512 in the longitudinal directions of the transmission members 42*c* and 42*d* (the rotational axis directions of the photosensitive drums 100).

The first stopper 56*a* and the second stopper 56*b* are provided on one end side in the longitudinal directions of the transmission members 42*a* to 42*d*. Thus, if the first cleaning holder 511 and the second cleaning holder 512 move in the direction of the arrow D1, the first cleaning holder 511 reaches end portions of the transmission members 42*a* and 42*b* in the direction of the arrow D1 and abuts the first stopper 56*a*.

Since the movement of the first cleaning holder 511 in the direction of the arrow D1 is restricted by the first stopper 56*a*, the load acting on the wind-up motor 55 that rotates the wind-up drum 59 to run the wire 54 becomes great. Since the wind-up motor 55 is controlled at a constant voltage, if the load acting on the wind-up motor 55 becomes heavy, the driving current flowing through the wind-up motor 55 increases. Thus, in a case where the value of the driving current detected by the current detecting unit 418 becomes greater than a predetermined value, the CPU 417 detects that the first cleaning holder 511 reaches the first stopper 56*a* (one end side in the longitudinal directions of the transmission members 42), and cleaning is completed. At this time, the second cleaning holder 512 is located on the other end side in the longitudinal directions of the transmission members 42*c* and 42*d*.

A series of cleaning operations by the movements of the first cleaning holder 511 and the second cleaning holder 512 in the present exemplary embodiment is as follows.

First, the wind-up motor 55 is driven to rotate in the CW direction, whereby the wire 54 runs in the direction of the arrow D2, and the first cleaning holder 511 and the second cleaning holder 512 move in the direction of the arrow D2.

Then, the second cleaning holder 512 reaches end portions of the transmission members 42*c* and 42*d* in the direction of the arrow D2 and abuts the second stopper 56*b*.

Since the movement of the second cleaning holder 512 in the direction of the arrow D2 is restricted by the second stopper 56*b*, the load acting on the wind-up motor 55 that rotates the wind-up drum 59 to run the wire 54 becomes great. The wind-up motor 55 is controlled at a constant voltage. Thus, according to the fact that the load acting on the wind-up motor 55 becomes heavy, the driving current flowing through the wind-up motor 55 increases. Thus, if the driving current detected by the current detecting unit 418 becomes greater than the predetermined value, the CPU 417 detects that the second cleaning holder 512 reaches the second stopper 56*b* (one end side in the longitudinal directions of the transmission members 42), and cleaning is completed.

Then, if it is detected that the second cleaning holder 512 reaches the second stopper 56*b*, the rotation of the wind-up motor 55 is stopped. At the detection, the first cleaning holder 511 reaches the other end side in the longitudinal directions of the transmission members 42. Thus, the rotation of the wind-up motor 55 is stopped, whereby the first cleaning holder 511 that has been moved stops on the other end side in the longitudinal directions of the transmission members 42.

Then, the wind-up motor 55 is rotated in the CCW direction to run the wire 54 in the direction of the arrow D1. This causes each of the first cleaning holder 511 and the second cleaning holder 512 to move in the direction of the arrow D1.

Then, the first cleaning holder 511 reaches the end portions of the transmission members 42*a* and 42*b* in the direction of the arrow D1 and abuts the first stopper 56*a*.

Since the movement of the first cleaning holder 511 in the direction of the arrow D1 is restricted by the first stopper 56*a*, the load acting on the wind-up motor 55 that rotates the wind-up drum 59 to run the wire 54 becomes great. Since the wind-up motor 55 is controlled at a constant voltage, if the load acting on the wind-up motor 55 becomes heavy, the driving current flowing through the wind-up motor 55 increases. Thus, in a case where the driving current detected by the current detecting unit 418 becomes greater than the predetermined value, the CPU 417 detects that the first cleaning holder 511 reaches the first stopper 56*a*.

If it is detected the first cleaning holder 511 reaches the first stopper 56*a*, the rotation of the wind-up motor 55 in the CCW direction is stopped, and the wind-up motor 55 is rotated in the CW direction by a predetermined amount. Consequently, the wire 54 is run by a predetermined distance in the direction of the arrow D2, and then, the rotation of the wind-up motor 55 is stopped.

As described above, in the present exemplary embodiment, one back-and-forth movement of each of the first cleaning holder 511 and the second cleaning holder 512 on the transmission members 42*a* to 42*d* is the series of cleaning operations. Then, when the series of cleaning operations ends, the wire 54 is run by the predetermined distance in the direction of the arrow D2, whereby the first cleaning holder 511 stops operating at the position where the first cleaning holder 511 does not abut the first stopper 56*a*, and the cleaning members 53 are not in contact with the surfaces of the transmission members 42.

That is, the first cleaning holder 511 is located between the end portions of the transmission members 42 in the longitudinal directions of the transmission members 42 and the first stopper 56*a*, and also in a non-transmission area where beams of laser light do not pass through the transmission members 42. In this state, the second cleaning holder 512 stops operating at the position where the second cleaning holder 512 does not abut the end portions of the transmission members 42 in the longitudinal direction, i.e., a non-transmission area where beams of laser light do not pass through the transmission members 42. The stop positions of the first cleaning holder 511 and the second cleaning holder 512 when the series of cleaning operations ends are a cleaning stop position and a cleaning start position.

In the above series of cleaning operations, if the second cleaning holder 512 reaches the second stopper 56*b*, the rotation of the wind-up motor 55 is stopped, and then, the wind-up motor 55 is rotated in the CCW direction. Alternatively, when the second cleaning holder 512 reaches the second stopper 56*b*, the wind-up motor 55 may be rotated in the CCW direction.

In the present exemplary embodiment, the wind-up motor 55 is rotated forward (rotated in the CW direction), to run the wire 54 in the direction of the arrow D1. Further, the wind-up motor 55 is rotated backward (rotated in the CCW direction), to run the wire 54 in the direction of the arrow D2. Alternatively, the wire 54 may be run in the direction of the arrow D2 by rotating the wind-up motor 55 forward and run in the direction of the arrow D1 by rotating the wind-up motor 55 backward.

Further, in the cover portion 40*b*, guide members 61*a* to 61*d* for guiding the movements of the first cleaning holder 511 and the second cleaning holder 512 are provided. Then, as illustrated in FIGS. 5 and 6, respective end portions of the first cleaning holder 511 are engaged with the guide members 61*a* and 61*b*.

Figure 5:
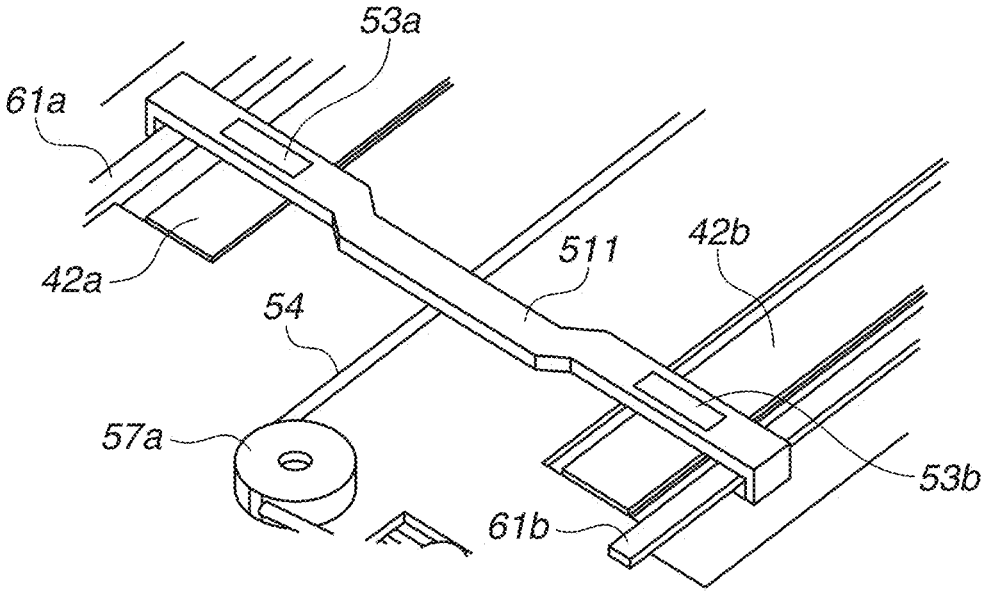
FIG. 5 is a partial perspective view of a first cleaning holder.

FIG. 5 is a partial perspective view illustrating the first cleaning holder 511 and its around. Also in the second cleaning holder 512, similarly to the configuration of the first cleaning holder 511, respective end portions of the second cleaning holder 512 are engaged with the guide members 61*c* and 61*d*. FIG. 6 is a partial cross-sectional view of an end portion of the first cleaning holder 511 on the side where the first cleaning holder 511 holds the cleaning member 53*a*. Although only the configuration of the first cleaning holder 511 is described here, in the present exemplary embodiment, a similar configuration is also used in the second cleaning holder 512.

Figure 6:
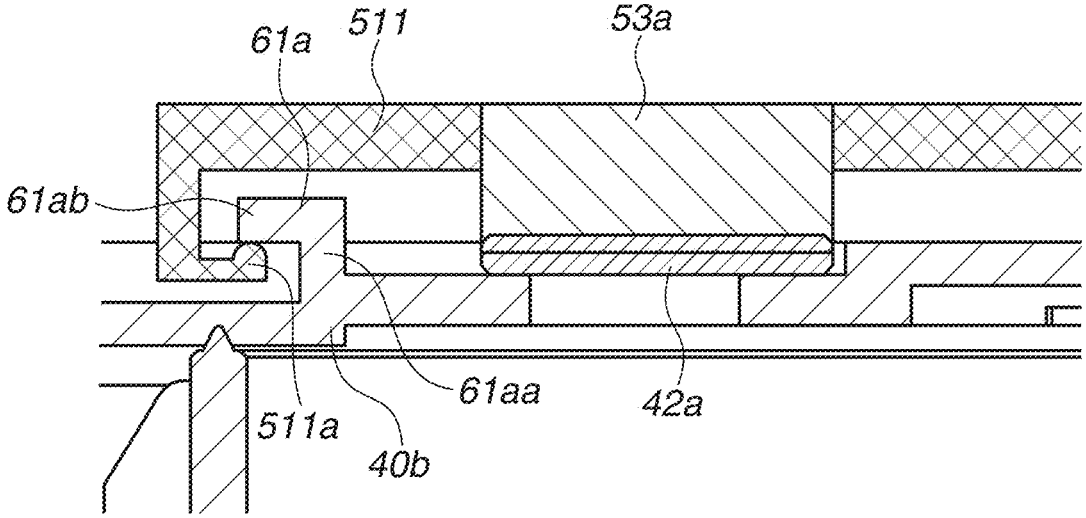
FIG. 6 is a partial cross-sectional view of the first cleaning holder.

As illustrated in FIGS. 5 and 6, the guide members 61*a* to 61*d* are formed integrally with the cover portion 40*b* and provided to protrude upward from the upper surface of the cover portion 40*b*.

As illustrated in FIG. 6, each of the guide members 61*a* to 61*d* includes a first protruding portion 61*aa* that protrudes upward relative to the upper surface of the cover portion 40*b*, and a second protruding portion blab that extends from the first protruding portion 61*aa* in a direction away from the cleaning member 53*a*.

Then, an end portion 511*a* on one end side of the first cleaning holder 511 is formed crawling under the second protruding portion blab. In the above described configuration, a portion of the end portion 511*a* that abuts the second protruding portion blab has an arc shape. The end portion 511*a* thus has an arc shape, whereby it is possible to reduce the sliding contact resistance of the first cleaning holder 511 moving in the direction of the arrow D1 or the direction of the arrow D2 (see FIG. 4).

In the present exemplary embodiment, although only one end side of the first cleaning holder 511 is described in detail, the other end side also has a similar configuration. Further, the second cleaning holder 512 also has a similar shape.

Further, the first cleaning holder 511 and the second cleaning holder 512 are engaged with the guide members 61*a* to 61*d*, to prevent the cleaning members 53*a* to 53*d* held by the first cleaning holder 511 and the second cleaning holder 512 from moving in directions away from the transmission members 42*a* to 42*d*. In this configuration, the engagement positions of the first cleaning holder 511 and the second cleaning holder 512 and the guide members 61*a* to

61*d* are in the positions where the cleaning members 53*a* to 53*d* are in contact with the transmission members 42*a* to 42*d* at predetermined contact pressure.

Further, according to the present exemplary embodiment, the guide members 61*a* to 61*d* and the first stopper 56*a* and the second stopper 56*b* are formed of a resin integrally with the cover portion 40*b*. Alternatively, the guide members 61*a* to 61*d* and the first stopper 56*a* and the second stopper 56*b* may be configured separately from the cover portion 40*b*.

(Adjustment Sequence)

Based on the intensity of the amount of laser light, the image forming apparatus 1 according to the present exemplary embodiment can adjust the density of an image (a toner image) to be formed on a recording sheet. Further, the density of the image may be controlled by controlling a developing bias. Meanwhile, even with a constant amount of laser light, the density of the image to be formed on the recording sheet may change due to a change in the temperature or a change in the humidity inside the housing of the optical scanning device 40. In the present exemplary embodiment, even if a surrounding environment such as the temperature or the humidity changes, the image forming apparatus 1 corrects the density of toner in such a manner that the density of the image to be formed on the recording sheet is an appropriate density, to adjust an image density, i.e., the density of the toner image. The image forming apparatus 1 according to the present exemplary embodiment executes an adjustment sequence, to set image formation conditions for correcting the image density. The image formation conditions are conditions such as the amount of laser light with which to expose each photosensitive drum 100, and the charge potential of the photosensitive drum 100. Such image formation conditions are stored in a non-volatile memory, such as the ROM 414.

In the present exemplary embodiment, the adjustment sequence is executed as follows. First, the CPU 417 controls the image forming unit including the optical scanning device 40 and the developing device 13 to form a toner pattern 601 as an example of an adjustment pattern on the photosensitive drum 100 based on the currently set image formation conditions. Consequently, the toner pattern 601 is formed on the photosensitive drum 100.

Next, the density sensor 453 (an example of a toner detecting unit) detects density information regarding the density of the toner pattern 601 from the toner pattern 601 formed on the photosensitive drum 100. Then, based on the information regarding the temperature or the humidity detected by the detecting unit 460 and the density information regarding the toner pattern 601 detected by the density sensor 453, new image formation conditions are set.

Although the details will be described below, there are two types of adjustment patterns, namely a toner pattern and a potential pattern. When a latent image formed on the photosensitive drum 100 is developed using toner, a pattern formed on the photosensitive drum 100 is referred to as a "toner pattern". On the other hand, an electrostatic latent image formed on the photosensitive drum 100 is referred to as a "potential pattern". That is, a potential pattern formed on the photosensitive drum 100 is developed using toner, thereby becoming a toner pattern. The density information may be calculated by the density sensor 453 detecting a potential pattern, or the density information may be formed by detecting a toner pattern.

Figure 7:
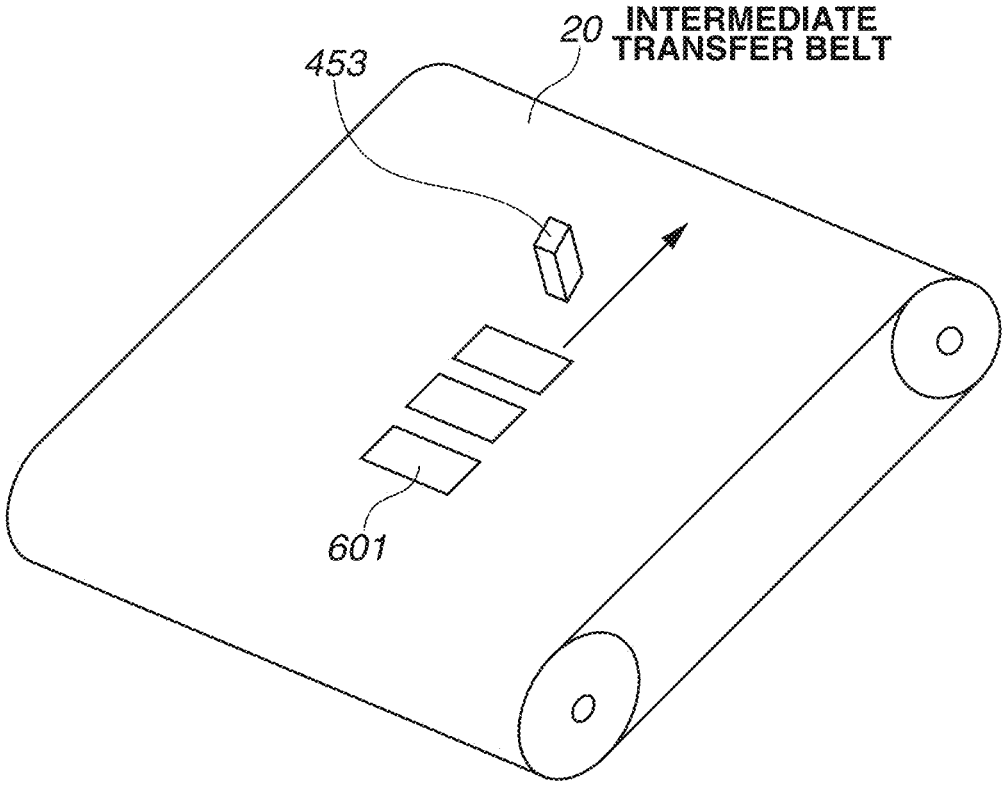
FIG. 7 is a diagram illustrating a positional relationship between a density detection sensor and an intermediate transfer belt.
Figure 8:
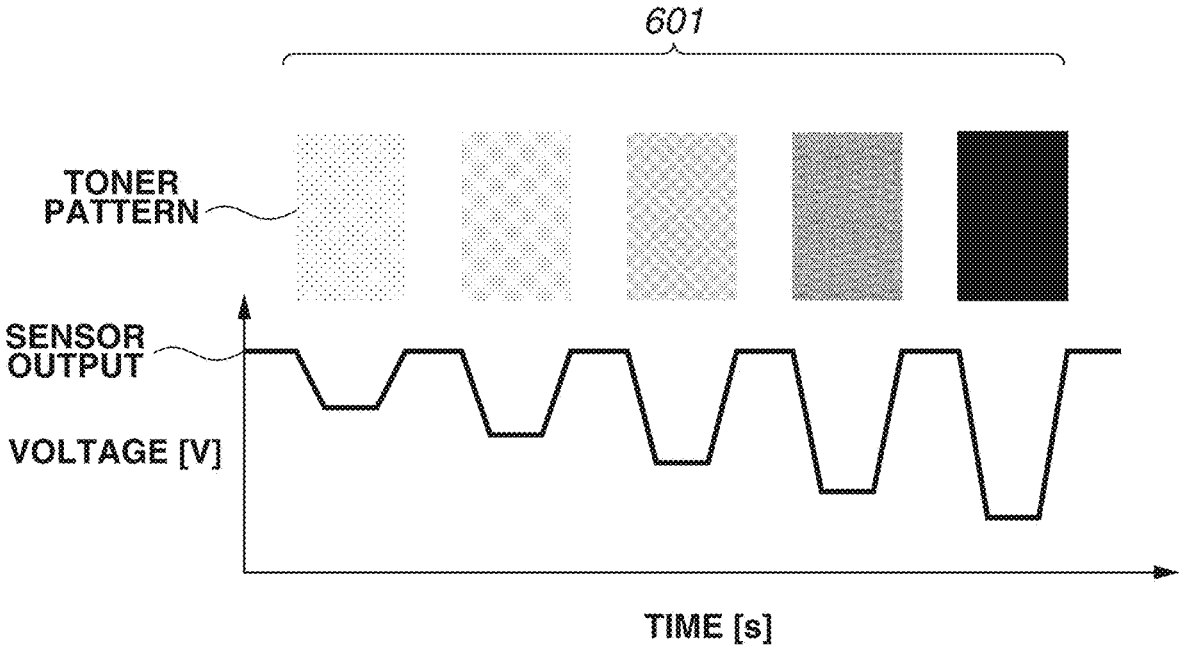
FIG. 8 is a diagram illustrating a relationship between a toner pattern and a sensor output.

As an example of a method to correct the density of toner for adjusting the image density, the toner pattern 601 is formed and the density of the toner pattern 601 is read using the density sensor 453. Generally, for example, some image forming apparatus 1 forms the toner pattern 601 on the intermediate transfer belt 20 as illustrated in FIG. 7. At this time, if the photosensitive drum 100 is exposed and developed by changing the amount of laser light, then as illustrated in FIG. 8, the toner patterns 601 each having different densities based on the amount of laser light are formed. Then, the density sensor 453 measures the toner patterns 601 conveyed by the intermediate transfer belt 20. Then, based on information regarding the toner densities measured by the density sensor 453 and the temperature or the humidity detected by the detecting unit 460, the setting value of the amount of laser light, which is a type of image formation conditions, are calculated.

The density sensor 453 illustrated in FIG. 7 is composed of a light-emitting diode (LED) light-emitting element and a light-receiving element such as a photodiode (PD). Instead of the LED light-emitting element, a laser light-emitting element may be used.

In the present exemplary embodiment, first, the light-emitting element irradiates each toner pattern 601 with light. The light-receiving element receives light reflected by the toner pattern 601 and detects the density based on an output voltage at this time. The lower the density of the toner pattern 601, the higher the output voltage. The higher the density of the toner pattern 601, the lower the output voltage.

FIG. 8 illustrates the toner patterns 601 formed on the intermediate transfer belt 20 and the output voltages of the toner patterns 601 read by the density sensor 453. According to the generation of an execution signal for the adjustment sequence, each of the toner patterns 601 is formed on the intermediate transfer belt 20. In the forming, the toner patterns 601 are formed on the intermediate transfer belt 20 while the amount of laser light is increased from a small amount of light to a large amount of light. That is, the image forming unit forms the toner pattern 601 on the photosensitive drum 100 according to the generation of the execution signal for the adjustment sequence. As illustrated in FIG. 8, the smaller the amount of laser light, the lower the density of the toner pattern 601. The larger the amount of laser light, the higher the density of the toner pattern 601.

The density sensor 453 measures the toner patterns 601 conveyed by the intermediate transfer belt 20, and the setting value of the amount of laser light leading to a target density is calculated from the setting value of the amount of laser light and the toner densities.

Figure 9:
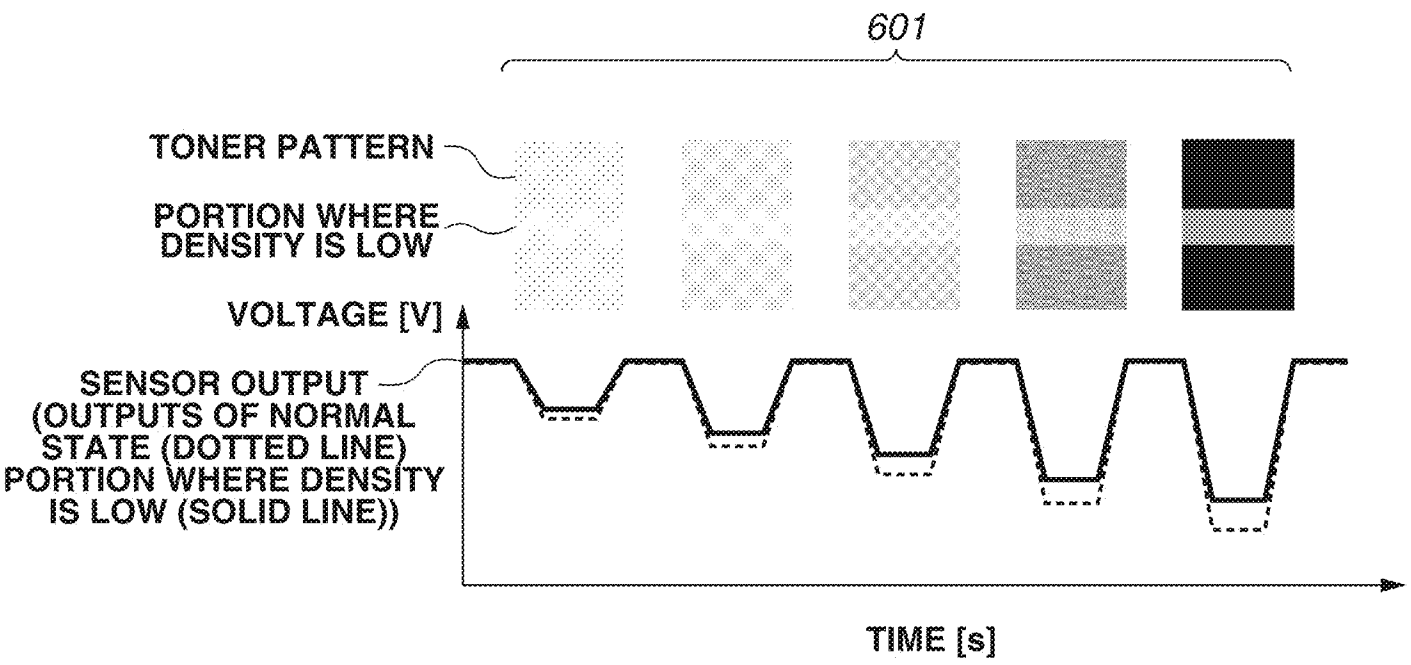
FIG. 9 is a diagram illustrating a relationship between a toner pattern and a density sensor output in a state where a foreign substance is attached to a transmission member.

If a foreign substance such as toner is attached to the transmission member 42, laser light is blocked, and the amount of light to irradiate the photosensitive drum 100 decreases. Thus, as illustrated in FIG. 9, the density of the toner pattern 601 may become partially low. As a result, the amount of change in the voltage (a solid line) of the toner pattern 601 detected by the density sensor 453 decreases as compared with the voltage (a dotted line) when the normal toner pattern 601 is detected in FIG. 8. Thus, an error occurs in the value of an appropriate amount of laser light obtained from the relationship between the detected density value and the amount of laser light. Due to this error in the value of the amount of light, a normal image density cannot be obtained.

Figure 10:
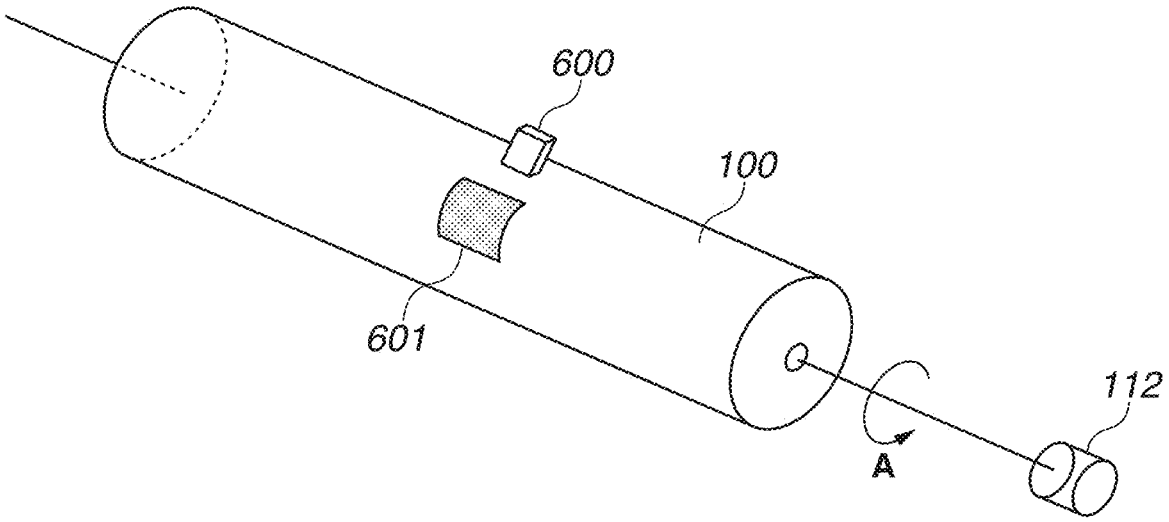
FIG. 10 is a diagram illustrating a positional relationship between a density detection sensor and a photosensitive drum.

The detection of the density of the toner pattern 601 on the intermediate transfer belt 20 has been described above. The exemplary embodiment, however, is not limited to this form. Alternatively, a method for forming the toner pattern 601 on the photosensitive drum 100 driven by a photosensitive member motor 112 as illustrated in FIG. 10 and reading the toner pattern 601 using a density sensor 600 provided near the photosensitive drum 100 may be used. The higher the density of the toner pattern 601, the smaller the value of the output voltage from the density sensor 600 when the density sensor 600 reads the toner pattern 601. Thus, the higher the density of the toner pattern 601, the greater the difference between the value of the output voltage when the density sensor 600 reads a portion where the toner pattern 601 is formed, and the value of the output voltage when the density sensor 600 reads a portion where the toner pattern 601 is not formed.

Further, reading the toner pattern 601 may be performed in such a manner that the toner pattern 601 as an adjustment image is printed on a sheet and the density of the toner pattern 601 is read using the document reading unit 305. In this case, first, the operator such as the user or the serviceman touches a button mark displayed as, for example, "execution of adjustment sequence" on the display 307 of the operation unit 304. If the operator touches the button mark, a "cleaning mode" mark and a "non-cleaning mode" mark are displayed on the display 307. On a selection screen where the "cleaning mode" mark and the "non-cleaning mode" mark are displayed, the operator selects either mode.

If the operator selects the "cleaning mode", the CPU 417 generates a driving signal for giving the optical scanning device driving unit 413 a command to drive the cleaning motor 423 of the optical scanning device 40. The wind-up motor 55 is driven in conjunction with the driving of the cleaning motor 423, and the first cleaning holder 511 and the second cleaning holder 512 move in the longitudinal directions of the transmission members 42. Consequently, the transmission members 42 are cleaned by the cleaning members 53. Then, although the details will be described below, if the CPU 417 determines that the cleaning is completed, the optical scanning device 40 and the developing devices 13 as the image forming unit form the toner patterns 601 on the photosensitive drums 100. In other words, after the cleaning mechanism 51 performs cleaning operations, the image forming unit forms the toner patterns 601 on the photosensitive drums 100. Then, a sheet on which images of the toner patterns 601 are formed is discharged to a sheet discharge unit inside the body of the image forming apparatus 1.

If, meanwhile, the operator selects the "non-cleaning mode", the CPU 417 does not generate a driving signal for giving a command to drive the cleaning motor 423, and causes the optical scanning device 40 and the developing devices 13 as the image forming unit to form the toner patterns 601 on the photosensitive drums 100. Then, similarly to the case where the "cleaning mode" is touched, a sheet on which images of the toner patterns 601 are formed is discharged to the sheet discharge unit inside the body of the image forming apparatus 1.

Next, the operator places on the document sheet feeding tray 300 the sheet on which the toner patterns 601 as adjustment images are formed. Then, the operator causes the document reading unit 305 to read the toner patterns 601 formed on the sheet. Based on the reading result of the document reading unit 305, the CPU 417 sets image formation conditions.

Figure 11:
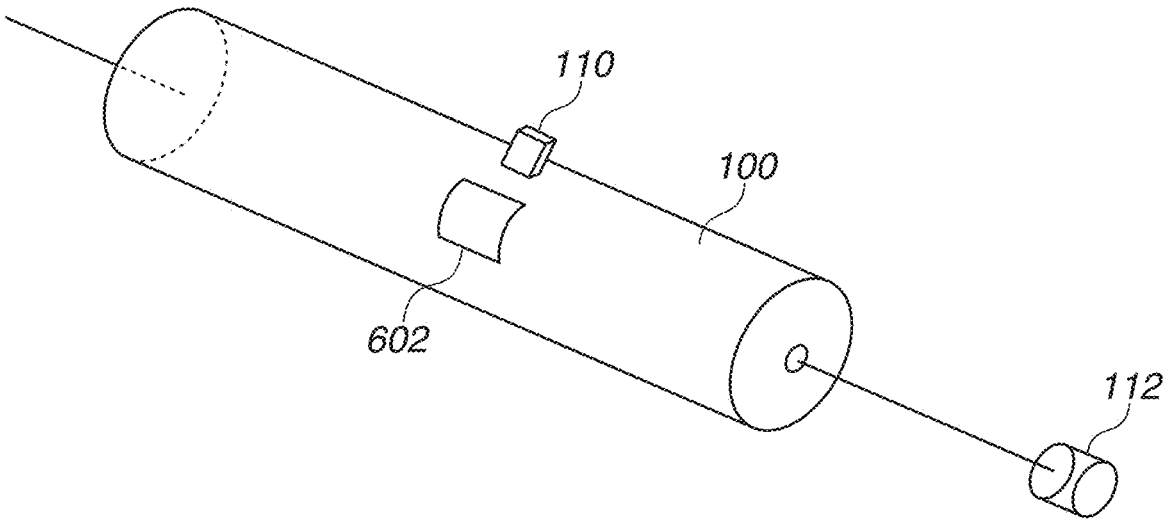
FIG. 11 is a diagram illustrating a positional relationship between a potential sensor and a photosensitive drum.

Yet alternatively, as illustrated in FIG. 11, a method for forming a potential toner pattern 602 as an example of an adjustment pattern on the photosensitive drum 100 and reading the potential of the potential toner pattern 602 using a potential sensor 110 provided near the photosensitive drum 100 may be used. The potential toner pattern 602 is an adjustment pattern that is not developed using toner.

Figure 12:
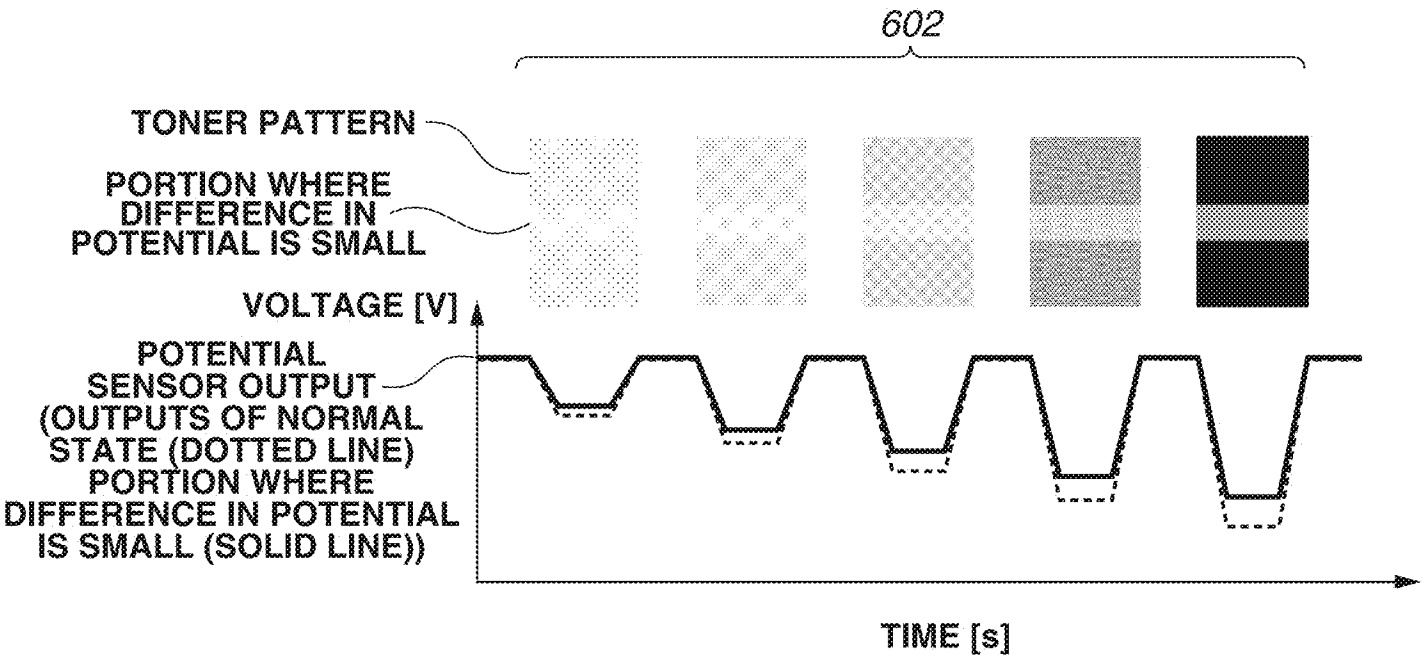
FIG. 12 is a diagram illustrating a relationship between a toner pattern and a potential sensor output in a state where a foreign substance is attached to a transmission member.

Although FIG. 11 illustrates the potential toner pattern 602, the potential of a pattern portion on the photosensitive drum 100 is only different from a portion other than the pattern portion, and the pattern shape cannot be seen by the naked eye. FIG. 12 schematically illustrates a latent image pattern such that the higher the density, the greater the difference in latent image potential from the non-exposed portion. In this case, the output of the potential sensor 110 is great in the non-exposed portion. The greater the amount of light when the latent image is generated, the smaller the output of the potential sensor 110, and the greater the difference in potential from the non-exposed portion. The potential sensor 110 measures the potentials of the potential toner patterns 602, and the amount of exposure and the charge potential of the photosensitive drum 100 are adjusted in such a manner that the difference in potential required for an appropriate density is obtained, to adjust the image density. The potential sensor 110 may be considered as an example of a density detecting unit.

In this method for reading the potential of the potential toner pattern 602, if a foreign substance such as toner is attached to the transmission member 42, laser light is blocked, and the amount of light to irradiate the photosensitive drum 100 decreases. Thus, as illustrated in FIG. 12, the potential of the potential toner pattern 602 may become partially low. As a result, the amount of change in the voltage (a solid line) of the potential toner pattern 602 detected by the potential sensor 110 decreases as compared with the voltage (a dotted line) in FIG. 12. Thus, an error occurs in the value of an appropriate amount of laser light obtained from the relationship between the detected density value and the amount of laser light. Due to this error in the value of the amount of light, a normal image density cannot be obtained.

As an example of the adjustment sequence, a sequence for image density adjustment has been described above. The "adjustment sequence" as used herein may mean a sequence for "color misregistration correction". The optical scanning device 40 of the image forming apparatus 1 according to the present exemplary embodiment emits beams of light corresponding to the respective colors. For example, if the temperature inside the housing of the optical scanning device 40 or the temperature inside the main body of the image forming apparatus 1 rises, the housing of the optical scanning device 40 thermally expands. Further, due to the influence of the heat distribution inside the housing of the optical scanning device 40, the housing of the optical scanning device 40 may thermally expand and deform in a complex manner. Consequently, the placement of a lens or a mirror may change. If an image forming process is performed in such a state, there is a possibility that color misregistration occurs.

For correcting color misregistration on the intermediate transfer belt 20, for example, a method for forming toner patterns 601 is known. Specifically, the density sensor 453 reads toner patterns 601 corresponding to the respective colors formed on the intermediate transfer belt 20. Based on the relative positional relationships between the toner patterns 601 corresponding to the respective colors read by the density sensor 453, image formation conditions are changed to correct color misregistration. The method for correcting color misregistration, however, is not limited to the above example.

(Cleaning Flow)

No matter what sequence the adjustment sequence is, the adjustment sequence includes the process of forming the toner pattern 601 on the photosensitive drum 100. Thus, if a foreign substance such as toner exists on the transmission member 42, the adjustment sequence cannot be executed with high accuracy. In view of the issue, when the adjustment sequence is executed, the cleaning of the transmission member 42 is considered before the execution of the adjustment sequence.

Figure 13:
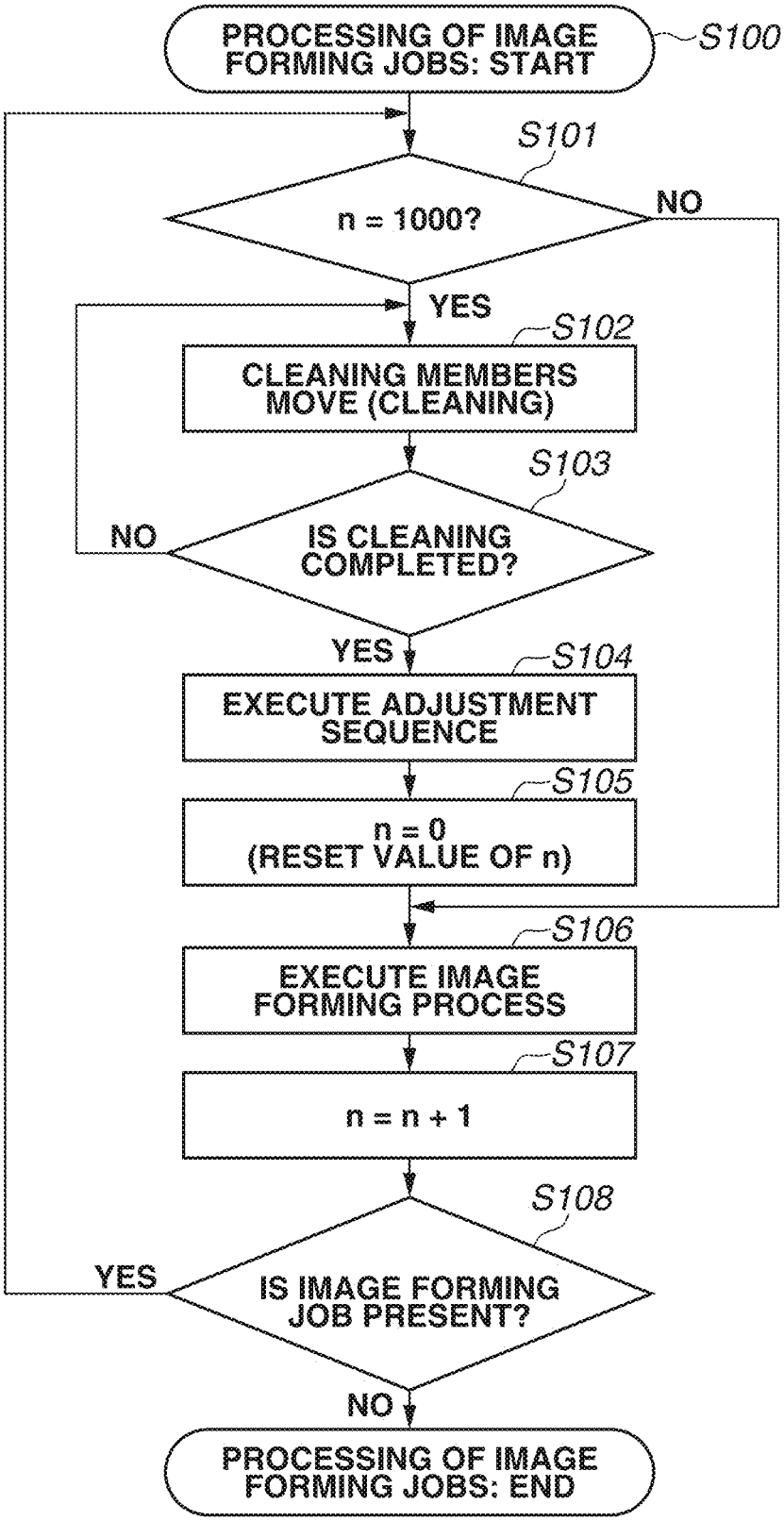
FIG. 13 is a flowchart according to a first exemplary embodiment illustrating a processing procedure in which cleaning and an adjustment sequence are inserted into processing of image forming jobs.

FIG. 13 is a diagram illustrating a flow where, every time the accumulated number of image formation pages reaches a predetermined number of pages, the adjustment sequence is executed. First, image forming jobs are input to the CPU 417. Then, at the timing when the CPU 417 gives the image formation units 10 a command to process the image forming jobs, then in step S100, the processing of the image forming jobs is started.

An image forming job is described. Examples of the image forming job include a copy job, a print job, and a fax job. The copy job is a job for executing an image forming operation based on image data acquired by the document reading unit 305. The print job is a job for executing an image forming operation based on print data, for example, described in a page description language (PDL) received from an external device such as a personal computer (PC). Further, the fax job is a job for executing an image forming operation based on facsimile data received from a fax transmitter.

In the process of step S101 in the flowchart illustrated in FIG. 13, the timing when the adjustment sequence (step S104) is performed is determined. Generally, even if the amount of laser light is corrected by executing the adjustment sequence once, the image density may change when the temperature or the humidity inside the image forming apparatus changes. Therefore, the time when printing is performed on a predetermined number of output pages determined in advance, or the time when a temperature sensor (an example of a detecting unit) installed inside the image forming apparatus 1 detects a change greater than or equal to an experimentally obtained threshold is defined as the adjustment timing of image formation conditions. A non-volatile memory such as the ROM 414 or the storage unit 416 stores this timing. The CPU 417 normally determines whether the timing stored in the ROM 414 or the storage unit 416 is the above adjustment timing. Then, if it is determined that the timing stored in the ROM 414 or the storage unit 416 is the adjustment timing, the CPU 417 generates an execution signal for the adjustment sequence.

The CPU 417 of the image forming apparatus 1 according to the present exemplary embodiment includes a counter for counting the number of times an image is formed on a recording sheet. As the counting method, when a recording sheet passes through the image formation units 10, 1 may be counted. Alternatively, when an image is formed on a recording sheet, 1 may be counted. Yet alternatively, when a video counter value counted by a video counting unit (not illustrated) indicates that a predetermined number or more of images are formed, 1 may be counted. When the number of times an image is formed is counted, for example, every time images are formed on a single sheet, 1 may be counted. Alternatively, every time an image is formed on either one of the front and back pages of a single sheet, 1 may be counted. For example, if two-sided printing is performed on an A4 sheet, this "single sheet" is a "two-page sheet". In this manner, the number of pages of sheets on which images are formed, or the number of sheets on which images are formed is counted.

Next, with reference to FIG. 13, a description is given of a configuration in which according to the fact that the accumulated number of image formation pages reaches 1000 pages, the adjustment sequence is inserted. The accumulated number of image formation pages is stored as a count value n in the storage unit 416. If a command to start the processing of the image forming jobs is given in step S100, then in step S101, the CPU 417 accesses the storage unit 416 and reads the count value n. Then, if the count value n is not 1000 (No in step S101), then in step S106, the CPU 417 executes an image forming process.

If the accumulated number of image formation pages reaches 1000 pages (YES in step S101), then in step S102, the CPU 417 generates the execution signal for executing the adjustment sequence. In the adjustment sequence, the CPU 417 generates a driving signal for giving the optical scanning device driving unit 413 a command to drive the cleaning motor 423 of the optical scanning device 40. This driving signal may be the execution signal itself, or may be a signal to be generated according to the execution signal. Then, the cleaning members 53 move while rubbing against the surfaces of the transmission members 42 from one end to the other end. Using the first cleaning holder 511, a description is given of the process of determining whether the cleaning is completed in step S103. The cleaning motor 423 moves the first cleaning holder 511 in the longitudinal directions of the transmission members 42*a* and 42*b*.

As described above, the value of the driving current flowing through the wind-up motor 55 detected by the current detecting unit 418 is input to the CPU 417. Then, the CPU 417 compares the detected value of the driving current with a predetermined value. If the value of the driving current detected by the current detecting unit 418 is greater than the predetermined value, the CPU 417 determines that the first cleaning holder 511 abuts the first stopper 56*a*. Then, it is determined that the cleaning is completed. That is, as illustrated in the flowchart in FIG. 13, unless it is determined that the cleaning is completed, the cleaning members 53 continue to rub against the surfaces of the transmission members 42.

If it is determined in step S103 that the cleaning is completed (YES in step S103), the optical scanning device 40 and the developing devices 13 as the image forming unit form the toner patterns 601 on the photosensitive drums 100. In other words, after the cleaning mechanism 51 performs cleaning operations, the image forming unit forms the toner patterns 601 on the photosensitive drums 100. If a series of operations of the adjustment sequence ends, and the image formation conditions are set, then in step S105, the CPU 417 resets the count value n to "0", for example. "The accumulated number of image formation pages" as used herein is the accumulated number of image formation pages since the adjustment sequence has previously been executed.

After the count value n is reset in the process of step S105, then in step S106, the image forming process is executed. "The execution of the image forming process" as used herein refers to the process of reading the image formation conditions and forming an image on a sheet.

If the image forming process is executed, and the formation of an image on a single page is completed, then in step S107, the CPU 417 increments the count value n by "1". In this manner, the accumulated number of pages of sheets on which images are formed is stored. Then, in step S108, the CPU 417 determines whether an image forming job is present. If it is determined in this process that an image forming job is not present, i.e., the processing of all the image forming jobs is completed (NO in step S108), the processing of the image forming jobs ends. If, on the other hand, it is determined that an image forming job is present (YES in step S108), the processing returns to step S101. In step S101, the CPU 417 confirms the count value n.

In the flowchart in FIG. 13, every time the accumulated number of image formation pages (the count value n)

reaches the predetermined number of pages (e.g., 1000 pages), the adjustment sequence is performed. The count value n, however, does not necessarily need to indicate the accumulated number of image formation pages, and may represent the accumulated number of formed images. That is, the number of sheets on which two-sided printing is performed corresponds to the count value n. Further, in the present exemplary embodiment, all the numbers of pages are counted on the premise of an A4 sheet. Thus, a numerical value by which the count value n is incremented may change based on the sheet size, for example, in such a manner that if an image is formed on one side of an A3 sheet, the count value n is incremented by "2". Even if printing is similarly performed on a single page, the larger the sheet size, the longer the rotation time of the polygon motor 422. That is, even if printing is similarly performed on a single page, the extent of the rise in the temperature inside the optical scanning device 40 is greater. In view of these reasons, a value by which the count value n is incremented may be set to be different with respect to each sheet size. Alternatively, the threshold (1000 in the present exemplary embodiment) to be compared with the count value n in the process of step S101 can be appropriately changed by the user or the serviceman.

Further, in the process of step S102, the operator may be allowed to determine whether cleaning is to be executed. In this case, the control unit 410 includes a selecting unit. If the count value n is the same as the threshold "1000" in the process of step S101, the selecting unit displays the "cleaning mode" mark and the "non-cleaning mode" mark on, for example, the display 307 of the operation unit 304. If the operator selects the "cleaning mode", the cleaning members 53 clean the transmission members 42. Then, in step S104, the CPU 417 generates the execution signal for the adjustment sequence. Meanwhile, if the operator selects the "non-cleaning mode", then in step S104, the cleaning members 53 do not clean the transmission members 42, and the CPU 417 generates the execution signal for the adjustment sequence.

Further, instead of the method for comparing the accumulated number of image formation pages with a threshold, a method for comparing the time elapsed since the adjustment sequence has previously been executed, with a threshold may be employed. In this case, in the process of step S101, the CPU 417 compares the time elapsed since the adjustment sequence has previously been executed that is stored in the storage unit 416, with a threshold. If the elapsed time exceeds the threshold, the CPU 417 executes cleaning and the adjustment sequence. Alternatively, the date and time when the adjustment sequence is performed may be stored, and using these values for comparison, the CPU 417 may calculate the time elapsed since the adjustment sequence has previously been performed.

In the present exemplary embodiment, every time an image is formed on a single page, the count value n is counted up, i.e., incremented by "1" such that n=1, 2, 3 . . . . Alternatively, the count value n may be counted down. In this case, every time an image is formed on a single page, the count value n is considered as being incremented by "4". As a threshold, for example, "−1000" is set.

Figure 14:
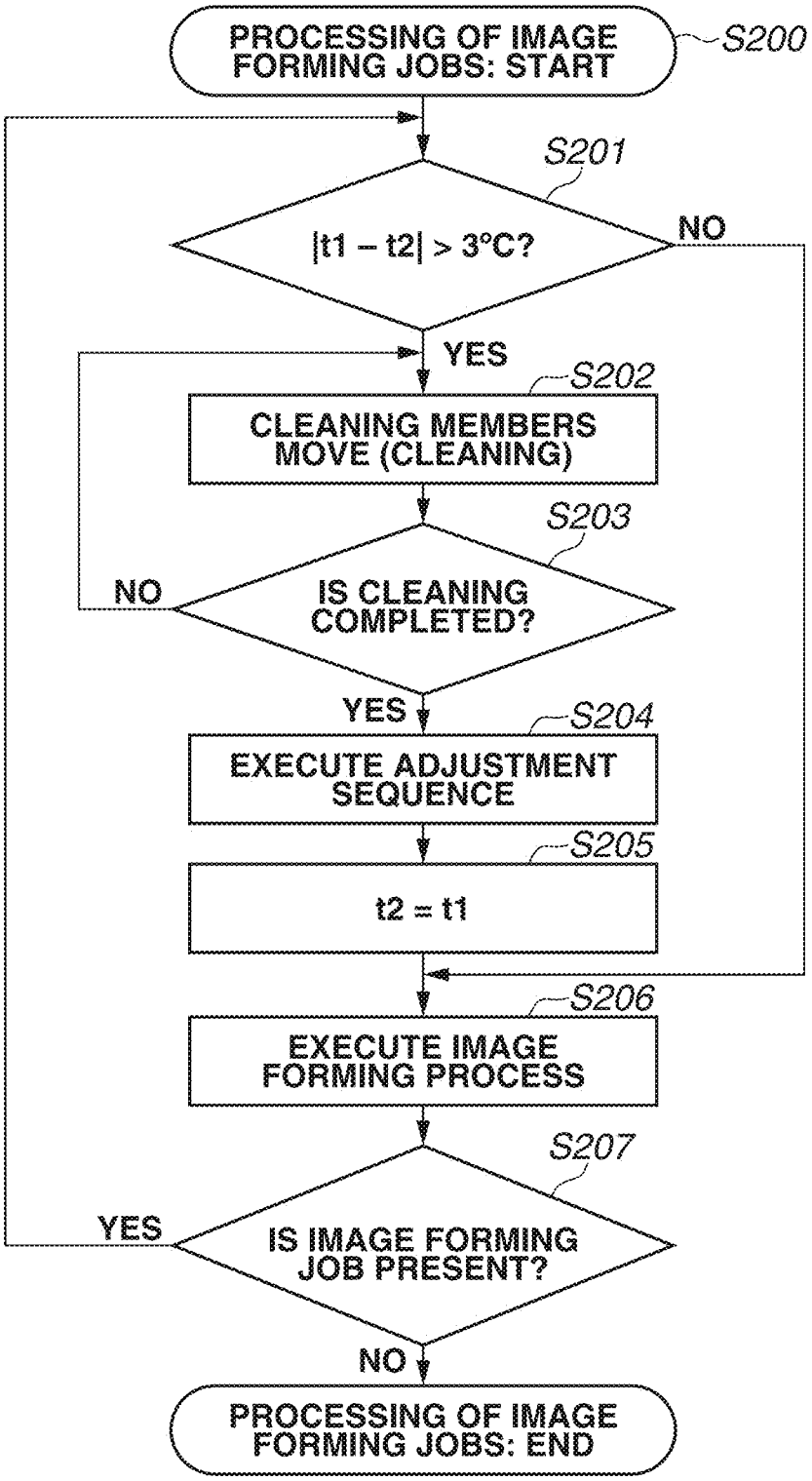
FIG. 14 is a flowchart according to a second exemplary embodiment illustrating a processing procedure in which cleaning and an adjustment sequence are inserted into processing of image forming jobs.

FIG. 14 is a flowchart in which if the absolute value of the difference between the temperature detected by the detecting unit 460 and the temperature detected by the detecting unit 460 when the adjustment sequence has previously been executed exceeds 3° C., the CPU 417 generates an execution signal for the adjustment sequence. In a second exemplary embodiment, the detecting unit 460 is a temperature sensor that always measures the temperature inside the main body of the image forming apparatus 1. In FIG. 14, a temperature t1 is the current temperature inside the main body of the image forming apparatus 1. Further, a temperature t2 is the temperature inside the main body of the image forming apparatus 1 when the adjustment sequence has previously been executed. The value of the temperature t2 is stored in, for example, the storage unit 416 (an example of a temperature storage unit).

In the process of step S200, if a command to start the processing of image forming jobs is given, the CPU 417 accesses the storage unit 416 and reads the value of the temperature t2. The CPU 417 calculates an absolute value |t1−t2| of the difference between the current temperature t1 detected by the detecting unit 460 and the temperature t2 read from the storage unit 416. Then, in step S201, the CPU 417 compares the absolute value with a predetermined value stored in the storage unit 416. In the present exemplary embodiment, the predetermined value is 3° C. Alternatively, the predetermined value can be changed by an operation of the operator such as the serviceman.

If the absolute value of the difference between the temperatures t1 and t2 does not exceed the predetermined value (NO in step S201), then in step S206, the CPU 417 executes an image forming process. Meanwhile, if the absolute value of the difference between the temperatures t1 and t2 exceeds the predetermined value (YES in step S201), then in step S202, the CPU 417 gives the optical scanning device driving unit 413 a command to drive the cleaning motor 423 of the optical scanning device 40. The process of determining whether the cleaning is completed (step S203) and the process of executing the adjustment sequence (step S204) are similar to those illustrated in the first exemplary embodiment.

If the adjustment sequence ends, then in step S205, the CPU 417 stores the value of the temperature t1 indicating the temperature inside the image forming apparatus 1 at this time, as the temperature t2 in the storage unit 416. Then, in step S206, the image forming process is executed. The process of determining whether an image forming job is present (step S207) after that is also similar to that illustrated in the first exemplary embodiment.

The method for determining the execution timing of the adjustment sequence does not need to be a method based on a change in the temperature inside the image forming apparatus 1. For example, instead of the temperatures t1 and t2 indicating the temperature inside the image forming apparatus 1, the humidity inside the image forming apparatus 1 may be used, and the execution timing of the adjustment sequence may be determined based on a change in the humidity. In this method, first, if an execution command to start the processing of image forming jobs is given, the CPU 417 accesses the storage unit 416 and reads the value of a humidity t2. A humidity t1 represents the current humidity inside the main body of the image forming apparatus 1, and the humidity t2 represents the humidity inside the main body of the image forming apparatus 1 when the adjustment sequence has previously been executed.

For example, if the temperature is 0° C. and the humidity is 20%, the amount of moisture in air indicating the humidity is about 1.0 g/kgDA (an amount of moisture of 1.0 g in 1 kg of atmosphere). If the temperature is 36° C. and the humidity is 90%, the amount of moisture in air is about 37.5 g/kgDA. This range is divided into eighths, for example, and if the amount of moisture in air changes by 4.6 g/kgDA from the previous execution of the adjustment sequence, the adjustment sequence is executed next. In other words, if the absolute value (|t1−t2|) of the difference between the amount of moisture in air when the adjustment sequence has previously been executed, and the amount of moisture in air currently monitored by a temperature and humidity detection sensor is greater than a predetermined value (4.6 g/kgDA in the present exemplary embodiment), the image forming unit generates an execution signal for the adjustment sequence.

The temperature and the humidity are not limited to the temperature and the humidity inside the image forming apparatus 1, and may be the temperature and the humidity outside the image forming apparatus 1. Further, the execution timing of the adjustment sequence may be determined based on a change in the temperature or a change in the humidity inside the optical scanning device 40.

Figure 15:
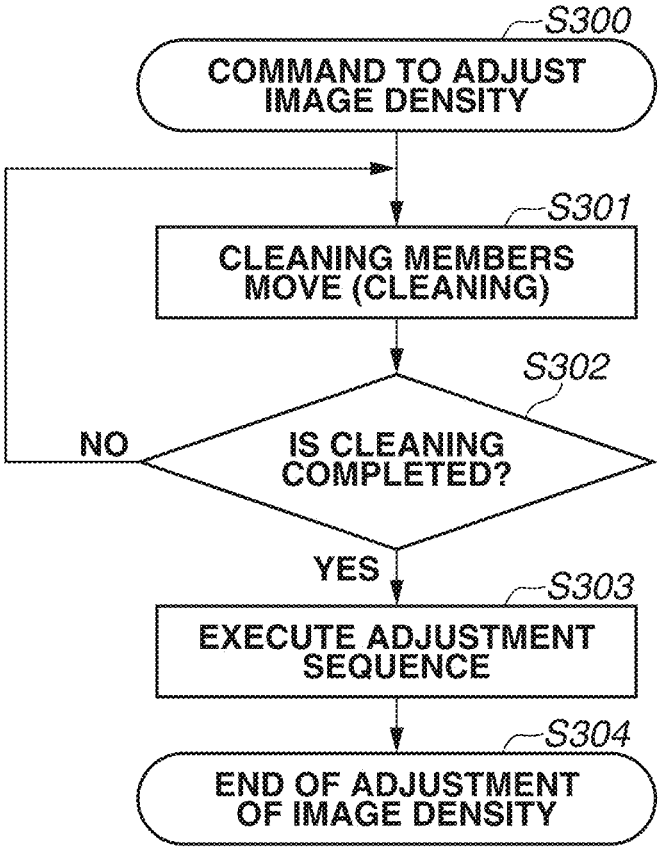
FIG. 15 is a flowchart according to a third exemplary embodiment illustrating a sequence in which an image density is adjusted based on an instruction from an operator.

FIG. 15 illustrates a flowchart in which, using as a trigger the fact that the operator such as the user or the serviceman operates the operation unit 304, the CPU 417 executes the adjustment sequence.

First, the operator such as the user or the serviceman operates the operation unit 304 to display a mark of an image density adjustment button on the display 307 of the operation unit 304. If the operator touches this mark, then in step S300, the CPU 417 gives a command to execute the adjustment sequence for image density adjustment. In this procedure, the operator does not necessarily need to input the command through the operation unit 304, and may input the command through an external device such as a PC.

In response to the CPU 417 generating an execution signal for the adjustment sequence, the optical scanning device driving unit 413 gives the optical scanning device 40 a command to drive the cleaning motor 423. Consequently, in step S301, the transmission members 42 are cleaned before the image density is adjusted as the adjustment sequence. The processes of steps S301 to S303 are similar to those described in the first and second exemplary embodiments, and therefore are not described here.

As described above, the transmission members 42 are cleaned before the CPU 417 generates the execution signal for the adjustment sequence, whereby it is possible to prevent a failure such as a density defect or a shape defect in the toner pattern 601 when the image density is adjusted. This eliminates a trouble in the detected value of the sensor as illustrated with reference to FIG. 9 or 12. Thus, it is possible to adjust the image density with high accuracy.

According to the above exemplary embodiments, the optical scanning device 40 is provided vertically below the image formation units 10. Alternatively, the optical scanning device 40 is provided vertically above the image formation units 10. In this configuration, since the transmission members 42*a* to 42*d* are provided above the image formation units 10, toner or paper dust does not fall from the image formation units 10. Scattered toner or paper dust, however, may be attached to the transmission members 42*a* to 42*d*. Thus, even in the configuration in which the optical scanning device 40 is provided vertically above the image formation units 10, the cleaning mechanism 51 is provided, whereby it is possible to remove a foreign substance such as toner or paper dust attached to the transmission members 42*a* to 42*d*.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of priority from Japanese Patent Application No. 2018-148617, filed Aug. 7, 2018, which is hereby incorporated by reference herein in its entirety.

What is claimed is:

1. An image forming apparatus comprising:

an image forming unit configured to develop an electrostatic latent image by using toner, the electrostatic latent image being formed on a photosensitive drum by scanning with laser light, the image forming unit having the photosensitive drum, and an optical scanning device, the optical scanning device having a light source configured to emit the laser light, a deflector configured to deflect the laser light so as to scan the photosensitive drum with the laser light emitted from the light source, and a longitudinal transparent window through which the laser light deflected by the deflector passes, wherein the image forming apparatus executes an adjustment sequence for adjusting an image forming condition for forming an image on a recording sheet, and the image forming unit forms an adjustment pattern on the photosensitive drum in the adjustment sequence;

a cleaning member configured to clean a surface of the transparent window while being contact with the surface of the transparent window;

a movement mechanism configured to reciprocate the cleaning member between one end side of the transparent window in a longitudinal direction of the transparent window and another end side of the transparent window in the longitudinal direction of the transparent window; and a control unit configured to control the image forming unit so as to cause the image forming unit to, after cleaning of the transparent window by the cleaning member reciprocated by the movement mechanism is completed, form the adjustment pattern on the photosensitive drum in the adjustment sequence.

2. The image forming apparatus according to claim 1, further comprising:

a detecting unit configured to detect a temperature inside a main body of the image forming apparatus; and a temperature storage unit configured to store the temperature detected by the detecting unit in response to the adjustment sequence being executed, wherein in a case where an absolute value of a difference between the temperature detected by the detecting unit and the temperature stored in the temperature storage unit is greater than a predetermined value, the control unit executes the adjustment sequence.

3. The image forming apparatus according to claim 1, further comprising:

a counter configured to count a number of pages of recording sheets on which toner images are formed by the image forming unit, wherein in response to the adjustment sequence being executed, the control unit resets a value of the counter, and in response to the value of the counter reaching a predetermined value, the control unit executes the adjustment sequence.

4. The image forming apparatus according to claim 1, further comprising:

a counter configured to count a number of recording sheets on which toner images are formed by transferring a toner image developed on the photosensitive drum, wherein in response to a value of the counter reaching a predetermined value, the control unit executes the adjustment sequence, and in response to the execution of the adjustment sequence, the control unit resets the value of the counter.

5. The image forming apparatus according to claim 1, further comprising:

a fixing device configured to fix, onto a recording sheet, a toner image of the adjustment pattern developed, to form an adjustment image on the recording sheet; and a reading device configured to read the adjustment image fixed onto the recording sheet by the fixing device, wherein the reading device aquires information about density of the adjustment image fixed onto the recording sheet, and wherein, based on the information about the density, the control unit adjusts an amount of light of the laser light with which the photosensitive drum is scanned.

6. The image forming apparatus according to claim 1, further comprising:

a toner density detecting unit configured to detect, on the photosensitive drum, a toner image of the adjustment pattern developed on the photosensitive drum by the image forming unit, wherein the toner density detecting unit acquires information about density of the toner image on the photosensitive drum, and wherein, based on the information about the density, the control unit adjusts an amount of light of the laser light with which the photosensitive drum is scanned.

7. The image forming apparatus according to claim 1, further comprising:

an intermediate transfer belt onto which a toner image of the adjustment pattern developed on the photosensitive drum is transferred; and a toner density detecting unit configured to detect, on the intermediate transfer belt, the toner image having been transferred onto the intermediate transfer belt, wherein the toner density detecting unit acquires information about density of the toner image on the intermediate transfer belt, and wherein the control unit adjusts an amount of light of the laser light with which the photosensitive drum is scanned.

8. The image forming apparatus according to claim 1, further comprising:

a housing that houses the deflector and has an elongated opening through which the laser light deflected by the deflector passes from inside to outside of the housing;

wherein the opening is closed by the transparent window from outside with respect to the housing, and wherein the cleaning mechanism cleans a surface of the transparent window by moving a cleaning member in a longitudinal direction of the transparent window.

9. The image forming apparatus according to claim 8, further comprising:

a pulley provided rotatably on the housing; and a wire attached to the pulley and stretched in the longitudinal direction of the transparent window;

wherein the cleaning member is provided on the wire.

10. An image forming apparatus comprising:

an image forming unit configured to develop an electrostatic latent image by using toner, the electrostatic latent image being formed on a photosensitive drum by scanning with laser light, the image forming unit having the photosensitive drum, and an optical scanning device, the optical scanning device having a light source configured to emit the laser light, a deflector configured to deflect the laser light so as to scan the photosensitive drum with the laser light emitted from the light source, and a transparent window through which the laser light deflected by the deflector passes, wherein the image forming apparatus executes an adjustment sequence for adjusting an image forming condition for forming an image on a recording sheet, and the image forming unit forms an adjustment pattern on the photosensitive drum in the adjustment sequence;

a cleaning mechanism configured to clean the transparent window;

a display unit provided with a display screen for accepting an input instruction from a user;

a storage unit into which the input instruction via the display screen is set; and a control unit configured to (1) control the image forming unit so as to cause the image forming unit to, after cleaning of the transparent window by the cleaning mechanism, form the adjustment pattern on the photosensitive drum in the adjustment sequence in a case where a setting corresponding to an input instruction for causing the cleaning mechanism to clean the transparent window is made into the storage unit, and (2) control the image forming unit so as to cause the image forming unit to, without cleaning the transparent window by the cleaning mechanism, form the adjustment pattern on the photosensitive drum in the adjustment sequence in a case where a setting corresponding to an input instruction for not causing the cleaning mechanism to clean the transparent window is made into the storage unit.

11. The image forming apparatus according to claim 10, further comprising:

a detecting unit configured to detect a temperature inside a main body of the image forming apparatus; and a temperature storage unit configured to store the temperature detected by the detecting unit in response to the adjustment sequence being executed;

wherein, in a case where an absolute value of a difference between the temperature detected by the detecting unit and the temperature stored in the temperature storage unit is greater than a predetermined value, the control unit executes the adjustment sequence.

12. The image forming apparatus according to claim 10, further comprising:

a counter configured to count a number of pages of recording sheets on which toner images are formed by the image forming unit;

wherein, in response to the adjustment sequence being executed, the control unit resets a value of the counter, and in response to the value of the counter reaching a predetermined value, the control unit executes the adjustment sequence.

13. The image forming apparatus according to claim 10, further comprising:

a counter configured to count a number of recording sheets on which toner images are formed by transferring a toner image developed onto the photosensitive drum;

wherein, in response to a value of the counter reaching a predetermined value, the control unit executes the adjustment sequence, and in response to the execution of the adjustment sequence, the control unit resets the value of the counter.

14. The image forming apparatus according to claim 10, further comprising a fixing device configured to fix, onto a recording sheet, a toner image of the adjustment pattern developed, to form an adjustment image on the recording sheet; and a reading device configured to read the adjustment image fixed onto the recording sheet by the fixing device;

wherein the reading device acquires information about density of the adjustment image fixed onto the recording sheet, and wherein, based on the information about the density, the control unit adjusts an amount of light of the laser light with which the photosensitive drum is scanned.

15. The image forming apparatus according to claim 10, further comprising:

a toner density detecting unit configured to detect, on the photosensitive drum, a toner image of the adjustment pattern developed on the photosensitive drum;

wherein the toner density detecting unit acquires information about density of the toner image on the photosensitive drum, and wherein, based on the information about the density, the control unit adjusts an amount of light of the laser light with which the photosensitive drum is scanned.

16. The image forming apparatus according to claim 10, further comprising:

an intermediate transfer belt onto which a toner image of the adjustment pattern developed on the photosensitive drum is transferred;

a toner density detecting unit configured detect, on the intermediate transfer belt, the toner image having been transferred onto the intermediate transfer belt;

wherein the toner density detecting unit acquires information about density of the toner image on the intermediate transfer belt, and wherein, based on the information about the density, the control unit adjusts an amount of light of the laser light with which the photosensitive drum is scanned.

17. The image forming apparatus according to claim 10, further comprising:

a housing that houses the deflector and has an elongated opening through which the laser light deflected by the deflector passes from inside to outside of the housing;

wherein the opening is closed by the transparent window from outside with respect to the housing, and wherein the cleaning mechanism cleans a surface of the transparent window by moving a cleaning member in a longitudinal direction of the transparent window.

18. The image forming apparatus according to claim 17, further comprising:

a pulley provided rotatably on the housing; and a wire attached to the pulley and stretched in the longitudinal direction of the transparent window;

wherein the cleaning member is provided on the wire.

19. The image forming apparatus according to claim 10, wherein the cleaning mechanism comprising:

a cleaning member configured to clean a surface of the transparent window while being in contact with the surface of the transparent window; and a movement mechanism configured to reciprocate the cleaning member between one end side of the transparent window in a longitudinal direction of the transparent window and another end side of the transparent window in the longitudinal direction of the transparent window, wherein the control unit is configured to control the image forming unit so as to cause the image forming unit to, after cleaning of the transparent window by the cleaning member reciprocated by the movement mechanism is completed, form the adjustment pattern on the photosensitive drum in the adjustment sequence in a case where a setting corresponding to an input instruction for causing the cleaning mechanism to clean the transparent window is made into the storage unit.

20. An image forming apparatus comprising:

an original reading device configured to read an image formed on an original;

an image forming unit configured to develop an electrostatic latent image by using toner, the electrostatic latent image being formed on a photosensitive drum by scanning with laser light, the image forming unit having the photosensitive drum, and an optical scanning device, the optical scanning device having a light source configured to emit the laser light, a deflector configured to deflect the laser light so as to scan the photosensitive drum with the laser light emitted from the light source, and a transparent window through which the laser light deflected by the deflector passes, wherein the image forming apparatus executes an adjustment sequence for adjusting an image forming condition for forming an image on a recording sheet, and the image forming unit forms an adjustment pattern that is to be read by the original reading device in the adjustment sequence;

a cleaning mechanism configured to clean the transparent window; and a control unit configured to control the image forming unit so as to cause the image forming unit to, after cleaning of the transparent window by the cleaning mechanism, form the adjustment pattern on the photosensitive drum in the adjustment sequence.

21. The image forming apparatus according to claim 20, further comprising:

a housing that houses the deflector and has an elongated opening through which the laser light deflected by the deflector passes from inside to outside of the housing;

wherein the opening is closed by the transparent window from outside with respect to the housing, and wherein the cleaning mechanism cleans a surface of the transparent window by moving a cleaning member in a longitudinal direction of the transparent window.

22. The image forming apparatus according to claim 20, wherein the cleaning mechanism comprising:

a cleaning member configured to clean a surface of the transparent window while being in contact with the surface of the transparent window;

a movement mechanism configured to reciprocate the cleaning member between one end side of the transparent window in a longitudinal direction of the transparent window and another end side of the transparent window in the longitudinal direction of the transparent window, wherein the control unit configured to the image forming unit so as to cause the image forming unit to, after cleaning of the transparent window by the cleaning member reciprocated by the movement mechanism is completed, form the adjustment pattern on the photosensitive drum in the adjustment sequence.

* * * * *